US008523544B2

(12) United States Patent
Shaffer

(10) Patent No.: US 8,523,544 B2
(45) Date of Patent: Sep. 3, 2013

(54) THREE STAGE SCROLL VACUUM PUMP

(75) Inventor: Robert W. Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 244 days.

(21) Appl. No.: 13/066,261

(22) Filed: Apr. 11, 2011

(65) Prior Publication Data

US 2011/0256007 A1 Oct. 20, 2011

Related U.S. Application Data

(60) Provisional application No. 61/342,690, filed on Apr. 16, 2010.

(51) Int. Cl.

| | |
|---|---|
| ***F01C 1/30*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/5; 418/55.1; 418/55.2; 418/55.3; 418/60; 418/101; 464/102

(58) Field of Classification Search
USPC ..... 418/5–6, 55.1–55.6, 57, 60, 101, 418/181; 464/102
See application file for complete search history.

(56) References Cited

U.S. PATENT DOCUMENTS

| | | | | |
|---|---|---|---|---|
| 3,011,694 | A * | 12/1961 | Audemar | 418/55.3 |
| 3,802,809 | A | 4/1974 | Vulliez | |
| 3,986,799 | A | 10/1976 | McCullough | |
| 3,994,636 | A | 11/1976 | McCullough et al. | |
| 4,192,152 | A * | 3/1980 | Armstrong et al. | 418/55.3 |
| 4,340,339 | A | 7/1982 | Hiraga et al. | |
| 4,415,317 | A | 11/1983 | Butterworth | |
| 4,416,597 | A | 11/1983 | Eber et al. | |
| 4,462,771 | A | 7/1984 | Teegarden | |
| 4,718,836 | A | 1/1988 | Pottier et al. | |
| 4,730,375 | A | 3/1988 | Nakamura et al. | |
| 4,892,469 | A | 1/1990 | McCullough et al. | |
| 5,160,253 | A | 11/1992 | Okada et al. | |
| 5,466,134 | A | 11/1995 | Shaffer et al. | |
| 5,632,612 | A | 5/1997 | Shaffer | |
| 5,752,816 | A | 5/1998 | Shaffer | |
| 5,759,020 | A | 6/1998 | Shaffer | |
| 5,855,473 | A * | 1/1999 | Liepert | 418/5 |
| 5,951,268 | A * | 9/1999 | Pottier et al. | 418/5 |
| 6,050,792 | A | 4/2000 | Shaffer | |
| 6,129,530 | A | 10/2000 | Shaffer | |
| 6,379,134 | B2 | 4/2002 | Iizuka | |
| 6,439,864 | B1 | 8/2002 | Shaffer | |
| 6,511,308 | B2 | 1/2003 | Shaffer | |
| 7,942,655 | B2 | 5/2011 | Shaffer | |
| 2007/0172373 | A1 * | 7/2007 | Ni | 418/55.3 |
| 2009/0246055 | A1 * | 10/2009 | Stehouwer et al. | 418/55.1 |

* cited by examiner

*Primary Examiner* — Theresa Trieu
(74) *Attorney, Agent, or Firm* — Paul M. Denk

(57) ABSTRACT

A three stage vacuum pump has three stages of fixed scrolls and orbiting scrolls that operate simultaneously. A motor drives the second orbiting scroll within the third fixed scroll upon three equally spaced idlers. One idler then transmits rotation and torque into the second stage. The second orbiting scroll to has involutes upon both surfaces to engage the second fixed scroll inwardly and the first fixed scroll outwardly. The first fixed scroll has fins upon its back that extend into the atmosphere to transfer heat to air cool the invention. This pump also has a fan accelerating heat transfer. The pump operates the scrolls directly from a motor or from a motor and magnetic coupling so that the atmosphere does not infiltrate the pump.

12 Claims, 16 Drawing Sheets

THREE STAGE SCROLL VACUUM PUMP

CROSS REFERENCE TO RELATED APPLICATION

This non provisional patent application claims priority to the provisional patent application having Ser. No. 61/342,690, which was filed on Apr. 16, 2010, which claims priority to the pending provisional application have Ser. No. 61/336,035 filed on Jan. 16, 2010 and claims priority to the non-provisional patent application having Ser. No. 11/703,585 which was filed on Feb. 6, 2007 and which claims priority to the provisional patent application having Ser. No. 60/773,274, which was filed on Feb. 14, 2006 which was filed during the pendency of PCT application Serial No. PCT/US01/50377 which was filed on Dec. 31, 2001 designating the U.S. and during the pendency of PCT application Serial No. PCT/US01/43523 which was filed on Nov. 16, 2001 designating the U.S., and which claimed priority to the U.S. non-provisional application Ser. No. 09/751,057 which was filed on Jan. 2, 2001, now U.S. Pat. No. 6,511,308, and which claimed priority to the continuation in part application Ser. No. 09/715,726 which was filed on Nov. 20, 2000, now U.S. Pat. No. 6,439,864.

BACKGROUND OF THE INVENTION

The three stage vacuum pump, and alternatively expander, relate generally to devices that alter or reduce the pressure of gases within a container, typically to very low vacuums or alternatively produce power as a gas expands. More specifically, these devices refer to multiple stages of scrolls that greatly increase the vacuums obtained during usage.

A unique aspect of the present invention is a three stage pump using various arrangements of scrolls that achieves vacuums of approximately 2 mt, that is, two milli-torr. These high vacuums apply to compact equipment such as portable mass spectrometers.

Scroll devices have been used as compressors and vacuum pumps for many years. In general, they have been limited to a single stage of compression due to the complexity of two or more stages. In a single stage, a spiral involute or scroll upon a rotating plate orbits within a fixed spiral or scroll upon a stationery plate. A motor shaft turns a shaft that orbits a scroll eccentrically within a fixed scroll. The eccentric orbit forces a gas through and out of the fixed scroll thus creating a vacuum in a container in communication with the fixed scroll. An expander operates with the same principle only turning the scrolls in reverse. When referring to compressors, it is understood that vacuum pump can be substituted for compressor and that an expander can be an alternate usage when the scrolls operate in reverse from an expanding gas.

Often oil is used during manufacture and operation of compressors. Oil free or oil less scroll type compressors and vacuum pumps have difficult and expensive manufacturing, due to the high precision of the scroll in each compressor and pump. For oil lubricated equipment, swing links often minimize the leakage from gaps in the scrolls by allowing the scrolls to contact the plate of the scroll. Such links cannot be used in an oil free piece of equipment because of the friction and wear upon the scrolls. If the fixed and orbiting scrolls in oil free equipment lack precision, leakage will occur and the equipment performance will decline as vacuums take longer to induce or do not arise at all.

Prior art designs have previously improved vacuum pumps, particularly the tips of the scrolls. In the preceding work of this inventor, U.S. Pat. No. 6,511,308, a sealant is applied to the two stage scrolls during manufacturing. The pump with the sealant upon the scrolls is then operated which distributes the sealant between the scrolls. The pump is then disassembled to let the sealant cure. After curing the sealant, the pump is reassembled for use. During use, this patented pump only achieves a vacuum on the order of 100 mt.

Then in U.S. Pat. No. 3,802,809 to Vulkliez, a pump has a scroll orbiting within a fixed scroll. Beneath the fixed disk, a bellows guides the gases evacuated from a container. The bellows spans between the involute and the housing, nearly the height of the pump. This pump and many others are cooled by ambient air in the vicinity of the pump.

In some applications, scroll type vacuum pumps have notoriety for achieving high vacuums. A few large scroll vacuum pumps can achieve vacuums as high as 50 mt. However, industry, science, and research still demand compact vacuum pumps that can achieve higher vacuums.

The present art overcomes the limitations of the prior art where a need exists for higher vacuums in equipment of compact form. That is, the art of the present invention, a three stage scroll vacuum pump utilizes a magnetic coupling for power transfer and fins upon the orbiting scroll and inside the housing for heat transfer, both without leakage of the working fluid.

SUMMARY OF THE INVENTION

Accordingly, the present invention improves a three stage vacuum pump and other related equipment with three stages of fixed scrolls and orbiting scrolls and each stage operates simultaneously. A motor drives the second orbiting scroll within the third fixed scroll as the third stage upon three equally spaced idlers. One idler then transmits rotation and torque into the second stage, that is, the second orbiting scroll. The second orbiting scroll has involutes upon both surfaces. The second orbiting scroll engages the second fixed scroll inwardly of the invention for the second stage. In the first stage, the second orbiting scroll engages a first fixed scroll outwardly from the center of the invention. The first fixed scroll of the first stage has fins upon its back surface that extend outwardly from the invention into the atmosphere for heat transfer as the invention is strictly air cooled. The present invention also includes a fan outside the housing to accelerate heat transfer. The scrolls receive torque and rotation directly from a motor or alternatively from a motor and a magnetic coupling or magnetic face seal so that the atmosphere does not infiltrate the housing of the three stages of scrolls. The present invention also has an enclosed inlet plenum to prevent mixture or infiltration of the working fluid into the heated fluid inside the housing.

Therefore, it is an object of the present invention to provide a new and improved three stage vacuum from the machine class of compressors, vacuum pumps, and expanders for gases.

It is a further object of the present invention to provide an enclosed housing of the orbiting and fixed scrolls.

It is a still further object of the present invention to provide air cooling of the vacuum pump thus increasing its efficiency.

It is an even still further object of the present invention to provide aligned fins on the back of the first fixed scroll, on the back of the second fixed scroll, and on the back of the third fixed scroll along with the back of the housing to transfer is heat from the orbiting scrolls outwardly to the ambient atmosphere.

It is a still further object of the present invention to provide a fan to move ambient air over the pump to accelerate heat transfer.

It is a still further object of the present invention to provide fins upon the scrolls that pump working fluid within the housing to increase heat transfer.

It is a still further object of the present invention to provide a magnetic coupling or magnetic face seal that separates the working fluid from the ambient atmosphere.

And, It is a still further object of the present invention to provide an enclosed inlet plenum that prevents mixing or infiltration of the working fluid into the heated fluid inside the housing.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

In referring to the drawings,

FIG. 10 illustrates a sectional view of the front surface of the orbiting scroll generally opposite that of FIG. 9 and the orbiting scroll has an enclosed plenum there through;

The same reference numerals refer to the same parts throughout the various figures.

DESCRIPTION OF THE PREFERRED EMBODIMENT

Figure 1:
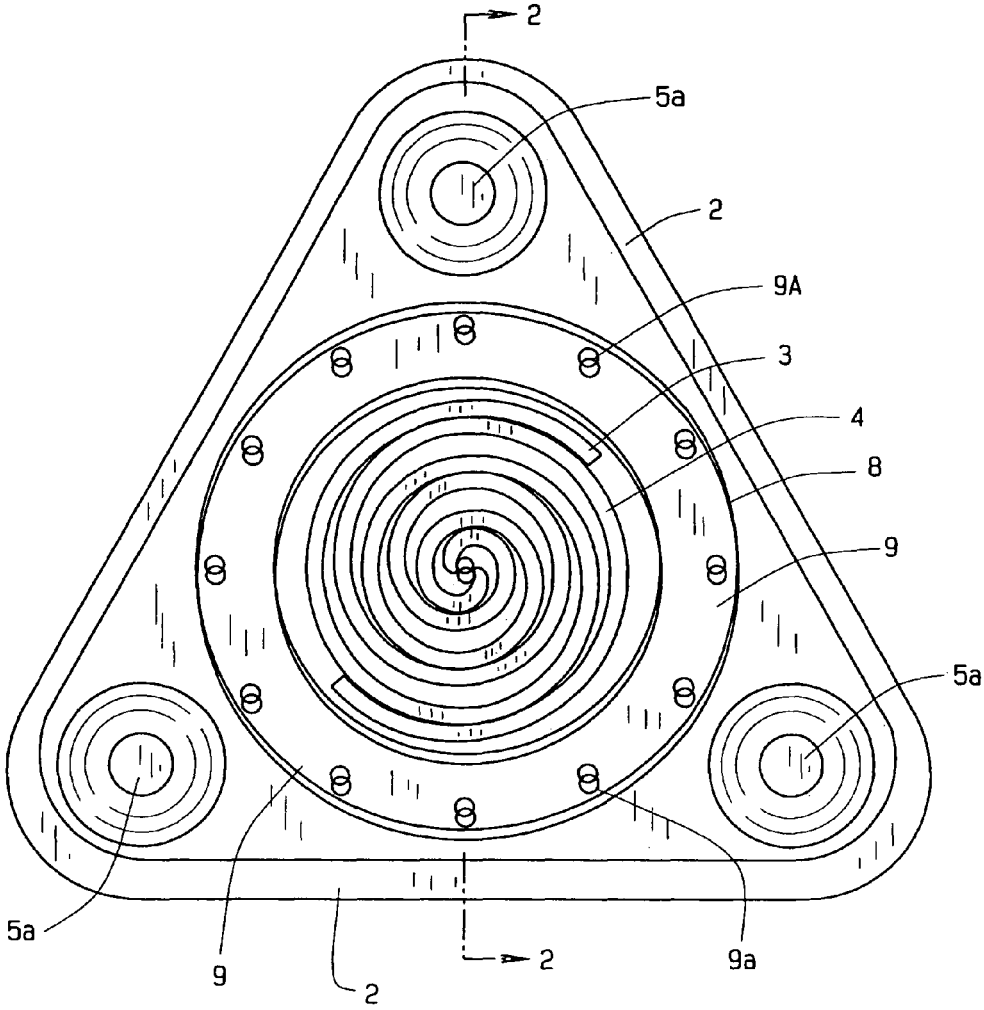
FIG. 1 shows a sectional view through both scrolls of a scroll compressor using an alternate embodiment of the present invention.

An alternate embodiment of the invention overcomes the prior art limitations by modifying scroll compressors and other pumps with bellows, liquid cooling using bellows, and tip seals. Turning to FIG. 1, a scroll compressor 1 appears in a sectional view through the scrolls. The scroll compressor 1 has a case 2 to contain the compressor 1 and scrolls. Within the case 2, the alternate embodiment of the invention has at least three equally spaced idlers 5*aa*. The idlers rotate eccentrically in cooperation with the scrolls as the scrolls compress or evacuate a gas from a container, not shown. The scrolls are located within the idlers and intermesh. The scrolls have a fixed scroll 3 of a generally spiral shape fixed to the compressor 1 and an orbiting scroll 4 also of a generally spiral shape. The orbiting scroll 4 fits within the fixed scroll 3 and as the orbiting scroll 4 turns, gas is drawn into the scrolls and evacuated from the compressor 1. A bellows 8 surrounds and seals the scrolls while remaining flexible. The bellows 8 has two mutually parallel flanges 9, each flange 9 joined to a scroll. The bellows 8 has a hollow round cylindrical shape that extends around the circumference of the scrolls. The bellows 8 can be made of metal, plastic, polymer, or an elastomer among other things. Electro forming, hydro forming, welding, and casting among other means form and shape the bellows 8.

Figure 2:
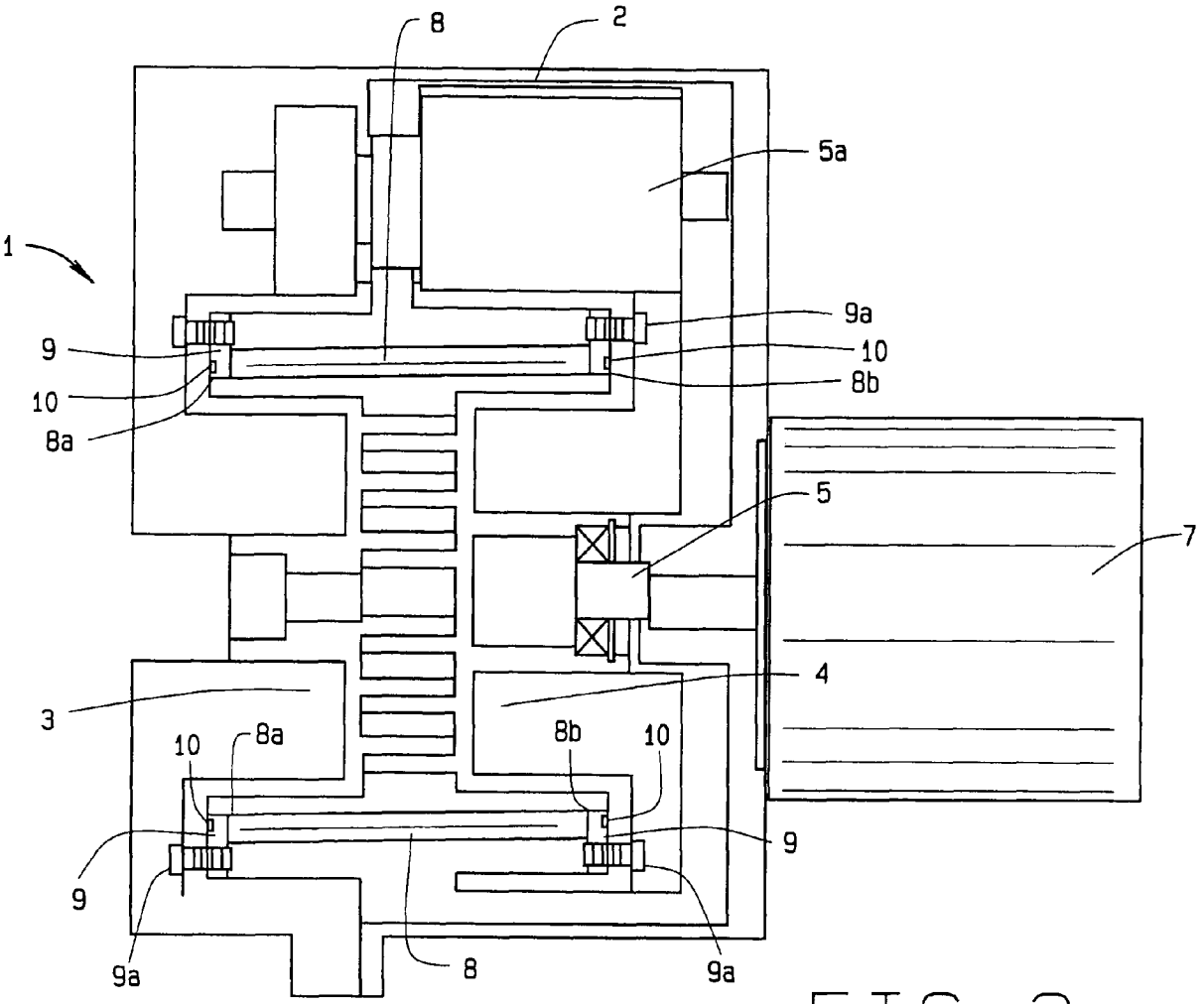
FIG. 2 shows a sectional view through a scroll compressor on a plane through the axis of rotation of the scrolls.

Turning a compressor 1 upon its side, FIG. 2 shows the workings of a compressor 1 in conjunction with a bellows 8. A motor 7 turns an axial shaft which connects with an eccentric shaft 5 that passes through a bearing. The eccentric shaft 5 connects with the orbiting scroll 4. The fixed scroll 3 is opposite the orbiting scroll 4 with an axis coaxial to the eccentric shaft 5. Operation of the motor 7 orbits the orbiting scroll 4 eccentrically which rotates the idlers and their attached counterweights. The idlers 5*aa* have an offset shaft to guide the orbiting motion of the orbiting scroll 4. The idlers and counterweights permit eccentric rotation of the orbiting scroll 4 while preventing destruction of the scrolls and the compressors 1 due to centrifugal forces.

Outwards of the scrolls upon the perimeter; an annular well forms within the compressor 1. The well generally extends around the circumference of the scrolls and at least the height of the scrolls outwards from the centerline of the scrolls. Within the annular well, the bellows 8 seals the scrolls. The bellows 8 as before has a generally hollow cylindrical shape with a round flange 9 upon each end. Here in section, the bellows 8 appears on edge as two equally spaced bands. The bellows 8 has a slight inclination to accommodate the eccentric shaft 5. Flanges 9 appear upon each end of the bands and connect the bellows 8 by bolting or other means to the scrolls. The flanges 9 have an annular shape with an inner diameter similar to the inner diameter of the bellows 8. In the preferred embodiment, the flanges 9 bolt to the scrolls. In alternate embodiments, the flanges 9 join the scrolls by welding or brazing. To fully seal the scrolls, the flanges 9 have a sealing ring 10. Here in section, the sealing ring 10 appears as four portions located at the ends of each band. The sealing rings 10 take up any gap between the flanges 9 and the scrolls thus sealing the bellows 8. O-rings or metal seals may serve as the sealing rings 10.

Figure 3:
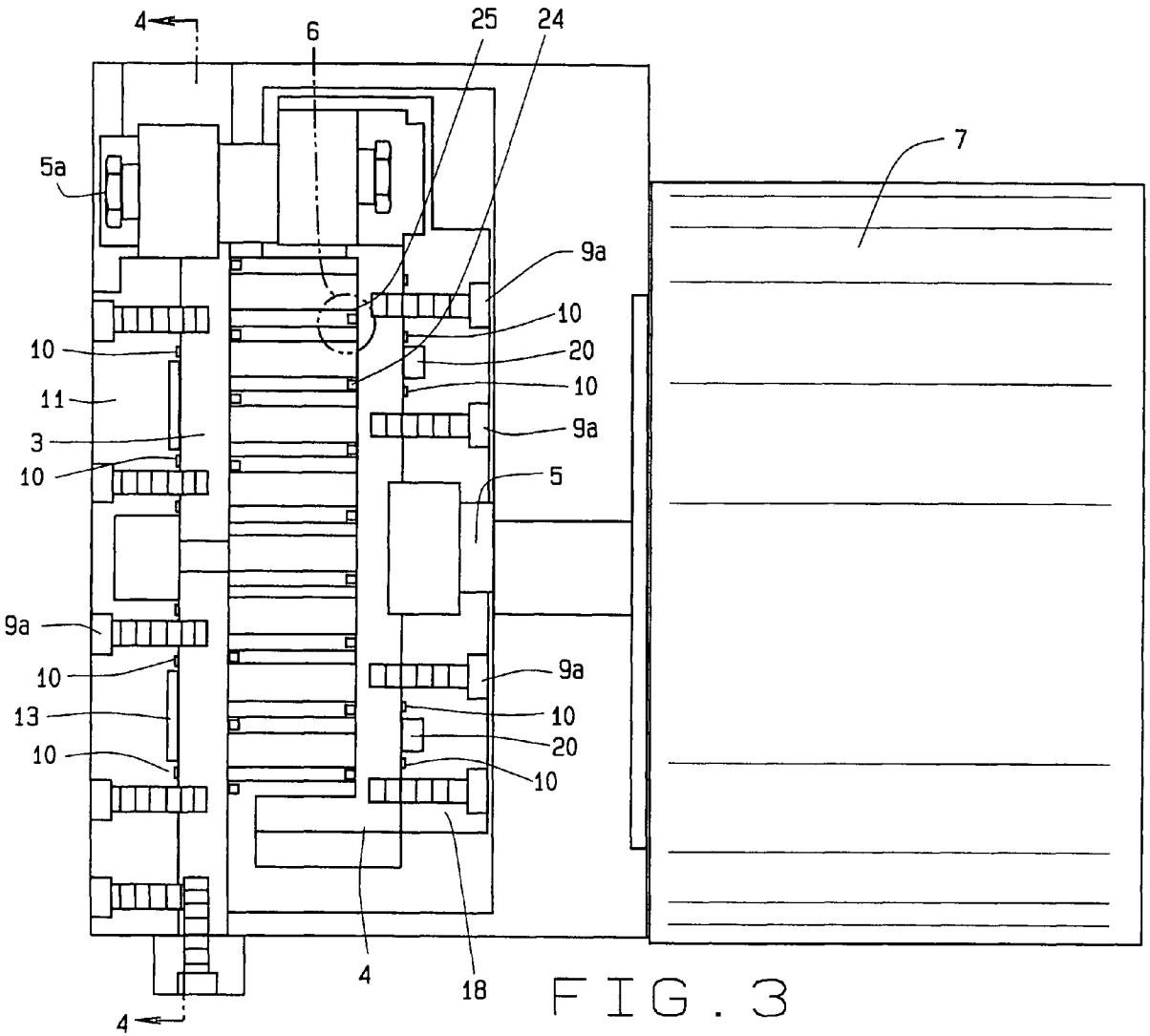
FIG. 3 describes a sectional view through a scroll compressor having liquid cooling.

Liquid cooling of a compressor 1 becomes possible for selected equipment and applications. Liquid cooling proves useful for compressors 1 in confined locations with limited access to air, such as boats or spacecraft. FIG. 3 shows the beginning of a liquid cooled compressor 1. As before, a motor 7 turns a shaft eccentrically connected to the scrolls. The alternate embodiment of the invention joins an orbiting cooling plate 18 to the orbiting scroll 4 and a fixed cooling plate 11 to the fixed scroll 3. The cooling plates join outwards from the scrolls so evacuation of gases continues unimpeded. The cooling plates have grooves 13, 20 upon their surfaces that form passages when joined against the scrolls. Liquid coolant then circulates through the passages and removes built up heat.

Figure 4:
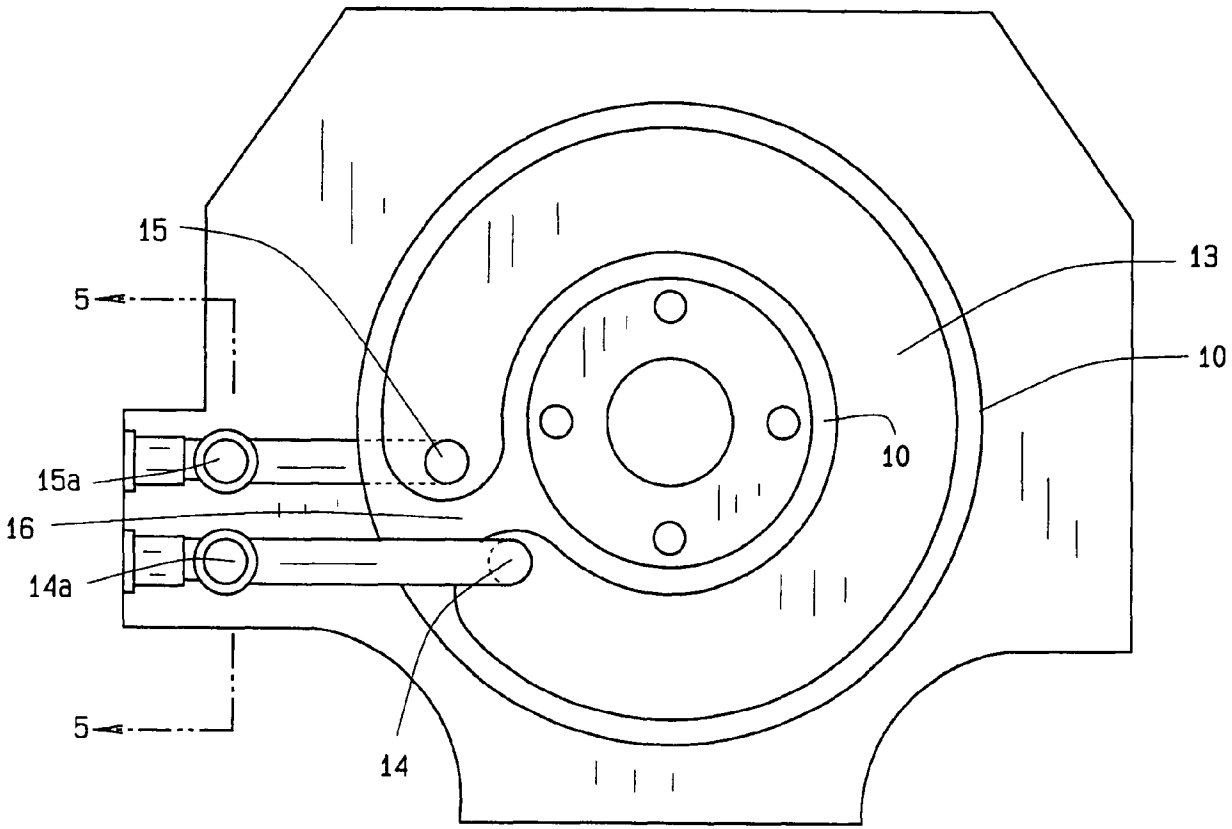
FIG. 4 describes a planar view of the cooling plate and its connection to the bellows of the alternate embodiment of the invention.

The grooves 13, 20 form a generally annular shape as shown in the sectional view of FIG. 4. The grooves 13 shown are in the fixed cooling plate 11 however the orbiting plate has similar grooves 20. The annular shape of the grooves 13 extends partially around the circumference and partially across the diameter of the fixed cooling plate 11. A wall 16 upon the fixed cooling plate 11 blocks the groove 13 from completely encircling the compressor 1. Proximate to the wall 16, the groove 13 has an aperture 14 in communication with an inlet for liquid coolant and on the other side of the wall 16, an aperture 15 in communication with an outlet to return the coolant for heat exchanging. O-rings 10 seal the inner and outer circumferences of the grooves 13 and apertures 14.

Figure 5:
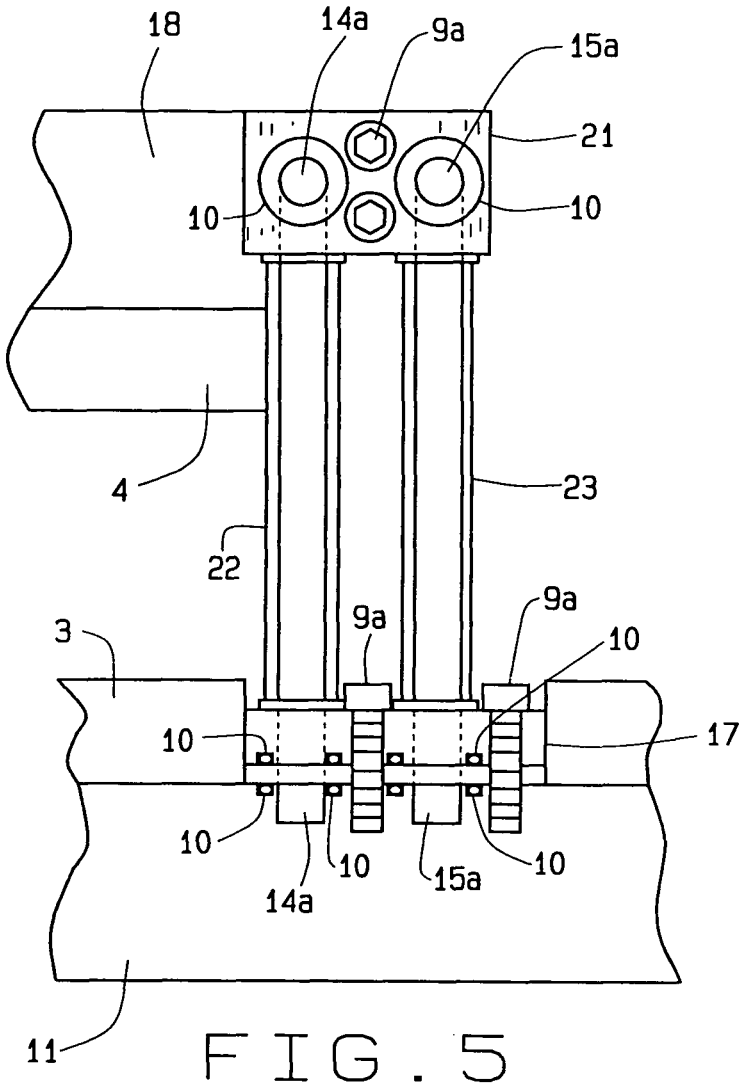
FIG. 5 illustrates a sectional view through the bellows and fittings for liquid cooling of a scroll compressor of the alternate embodiment of the invention.

Referencing the inlet and the outlet of FIG. 4, FIG. 5 shows a pair of bellows 22, 23 for conducting liquid coolant into and out of the cooling plates for cooling the compressor 1 during operation. The cooling liquid is pumped into the inlet upon the fixed cooling plate 11, enters an aperture 14, and then travels through the passage 20 to cool the fixed cooling plate 11. A portion of the cooling liquid travels through the first bellows 22 into the inlet aperture 14 upon the orbiting cooling plate 18. The portion of the cooling liquid then enters the passage 20 to cool the orbiting cooling plate 18. The cooling liquid portion then exits the outlet aperture 14 into the second bellows 23. The second bellows 23 also collects cooling liquid from the outlet aperture 14 of the fixed cooling plate 11. The second bellows 23 returns the generally heated cooling liquid from both cooling plates to the outlet for communication to a heat exchanger. The bellows 22, 23 have a hollow cylindrical shape with a flange upon each end sealed to the respective scrolls with sealing rings 10. The flanges join to the bellows by bolting preferably or alternatively by brazing or welding.

Upon the fixed scroll 3, the first bellows 22 and the second bellows 23 join to a first end plate 17. The first end plate 17 has a generally rectangular shape incorporated into the fixed scroll 3 and an upper surface and an opposite lower surface. The first end plate 17 bolts to the fixed scroll 3 in the preferred embodiment with the upper surface towards the orbiting scroll 4. Here the bolts 9*a* are located upon a line through the centers of the first bellows 22 and the second bellows 23. The first and second bellows join to the upper surface of the first end plate 17. Upon the lower surface, O-rings 10 seal fittings for the inlet and outlet of liquid coolant for the compressor 1. The O-rings 10 and fittings have a generally hollow round shape to ease connection of lines carrying the liquid coolant to and from the compressor 1.

Then upon the orbiting scroll 4, the first bellows 22 and the second bellows 23 join a second end plate 21. The second end plate 21 is fastened into the orbiting cooling plate 18, generally perpendicular to the first end plate 17. The second end plate 21 bolts to the orbiting cooling plate 18 with the bolts 9*a* upon the lateral axis of the second end plate 21, generally between the first and second bellows 23. O-rings 10 seal the first bellows 22 and the second bellows 23 to the second end plate 21.

Figure 6:
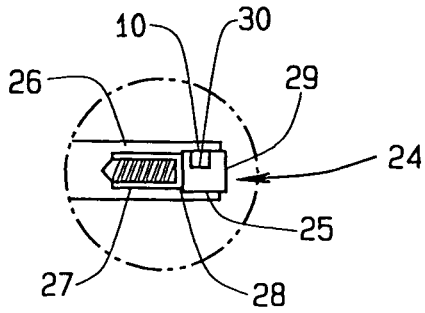
FIG. 6 shows a sectional view through one tip of a scroll having an improved seal of the alternate embodiment of the invention.

Turning to FIG. 6, the alternate embodiment of the invention modifies the tips 24 of the fixed scroll 3 and the orbiting scroll 4. Each scroll joins perpendicular to a plate. Opposite the plate, each scroll has an exposed tip 24 in a general spiral pattern. The tip 24 then has a groove 25 open away from the base. The groove 25 extends for the length of the scroll. A plurality of holes 26 is spaced along the length of the spiral. The diameter of each hole 26 is approximately the width of the groove 25. The alternate embodiment of the invention places into each hole a spring 27 upon a plunger 28, where the spring 27 biases against the plunger 28 outwardly. The plunger 28 has a diameter and shape slightly less than the hole 26. Upon the plunger 28 opposite the spring 27 and towards the tip 24 itself, a seal 29 abuts the opposing scroll. The seal 29 has a complementary shape to the hole 26. In an alternate embodiment, the seal 29 has a secondary O ring seal. The secondary O ring 10 extends in a groove 30 around the circumference of the seal 29. The spring 27 and the secondary O ring 10 prevent leakage between the scrolls as the seals 29 wear during use.

The modifications of this alternate embodiment also include a method of sealing the scrolls of a compressor 1. To attain high vacuums and maximum efficiency, imperfections and deviations in the scrolls must be sealed. Previously, epoxy was applied to the surfaces of the scrolls 3, 4, a compressor 1 was assembled and operated for a time, then the scrolls were disassembled and the tip seal grooves 25 cleaned, and then the epoxied scrolls were reassembled into a compressor 1. The alternate embodiment of the invention applies a mold release or other material upon the tips 24 of the scrolls for filling the tip seal groove 25, assembles the scrolls together, injects epoxy into the scrolls, then operates the compressor 1 for a time to disperse the epoxy. The mold release inhibits the adhesion and accumulation of epoxy upon the tips 24 thus reducing the need to disassemble, to clean, and then to reassemble the compressor 1. In the alternate embodiment of the invention, the epoxy occupies any gaps between the adjacent scroll's plate. The method of the alternate embodiment of the invention may eliminate the need for a tip seal 29 as previously described. In the preferred embodiment of this method, the mold release is a lubricating fluid. In an alternate embodiment, this method uses a mold release selected from elastomers, gels, greases, low hardness plastics, and pliable sealants. The method of the alternate embodiment of the invention applies to scroll compressors, vacuum pumps, and expanders alike.

Figure 7:
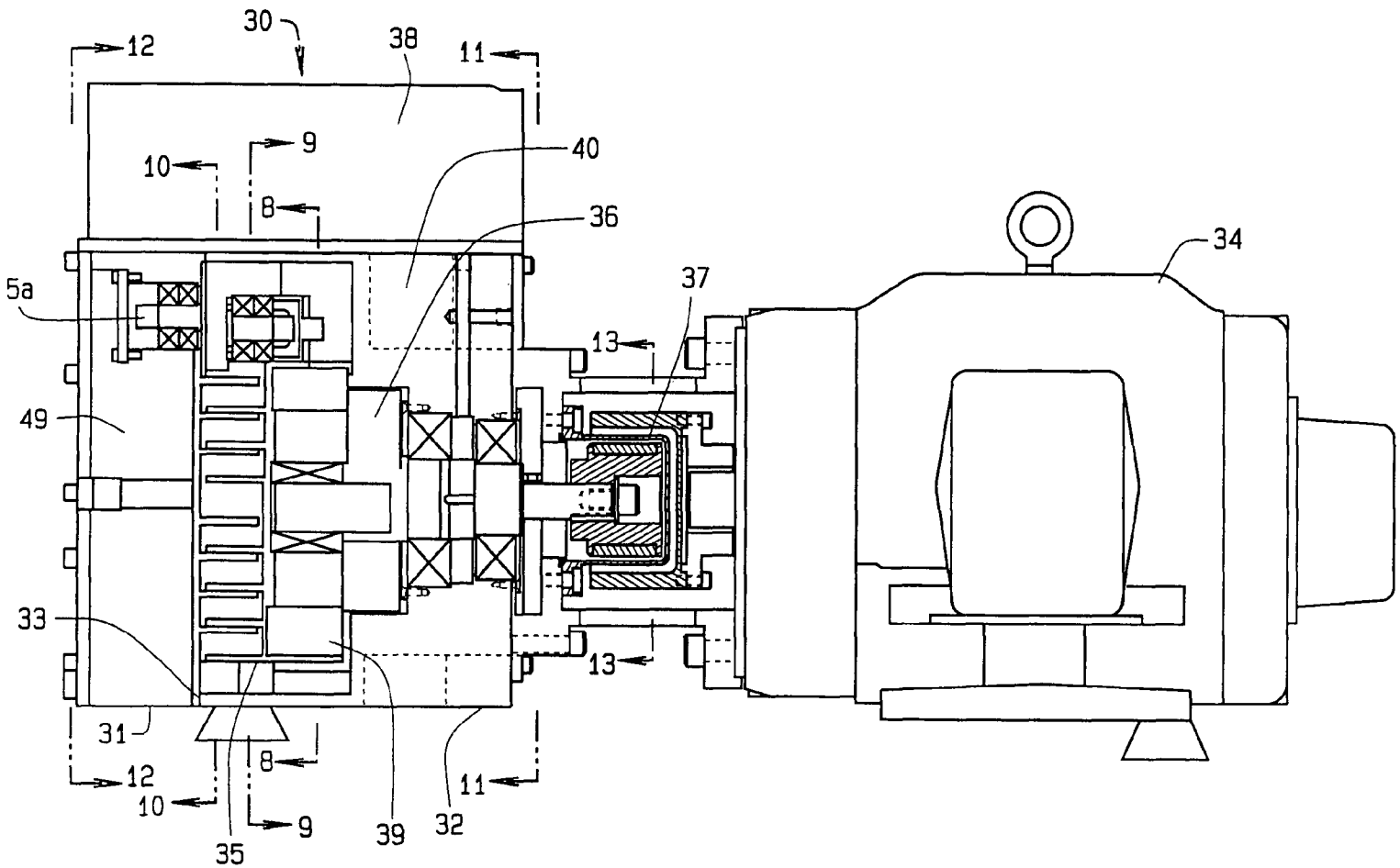
FIG. 7 shows a sectional view lengthwise through the housing of the present invention.

Now FIG. 7 shows the present invention of this application, a scroll type fluid displacement device that compresses or expands gases other than air. This invention can operate as hydrogen recirculation pumps used in fuel cells, natural gas compressors used in micro-turbines, tritium vacuum pumps, Rankin cycle expanders, and the like. These applications require a completely enclosed housing so that the fluid undergoing compression or expansion does not leak from the housing into the nearby atmosphere or that the nearby atmosphere does not leak through the housing into the fluid undergoing compression or expansion. The fluid undergoing compression or expansion for application outside the invention is called the working fluid. In the present invention, the housing includes cooling fluid contained within the housing. The working fluid and the cooling fluid are the same material in case of leakage within the housing. When compressing or expanding these working fluids, heat arises in the various components of the present invention. The present invention though transfers heat from its fixed scroll and its orbiting scroll to the nearby atmosphere without leakage into the housing. Movement of the scrolls calls for transmission of power to the components of the invention also without leakage of the fluid undergoing compression or expansion.

FIG. 7 shows a cross section of the scroll device 30 where a fixed scroll 31 is bolted to a housing 32. An O-ring 33 is positioned around the outside of the fixed scroll 31 and the housing 32 to seal the working fluid within the housing. The housing and the scrolls inside are coupled to a motor 34 here shown adjacent to the housing. The fixed scroll and an orbiting scroll 35 constitute the basic compressing, or alternatively expanding elements. An eccentric shaft 36 drives the orbiting scroll 35 during usage. Additionally, the eccentric shaft has a magnetic coupling 37, or alternatively a shaft seal, for transmitting the torque from the motor 34 into the orbiting scroll 35 for appropriate rotation without leakage of the working fluid to the atmosphere. Generally, the motor 34 supplies rotation to the magnetic coupling 37 which them imparts rotation and torque to the orbiting scroll 35 for usage as a compressor or vacuum pump while a generator supplies rotation to the orbiting scroll when the invention 30 is used as an expander. The fixed scroll 31, orbiting scroll 35, and housing 32 each have fins thereon, as later shown and described, for transferring heat primarily from the fixed and, orbiting scrolls to the housing for evacuation by conduction or a fan 38 integrated into the housing.

Figure 8:
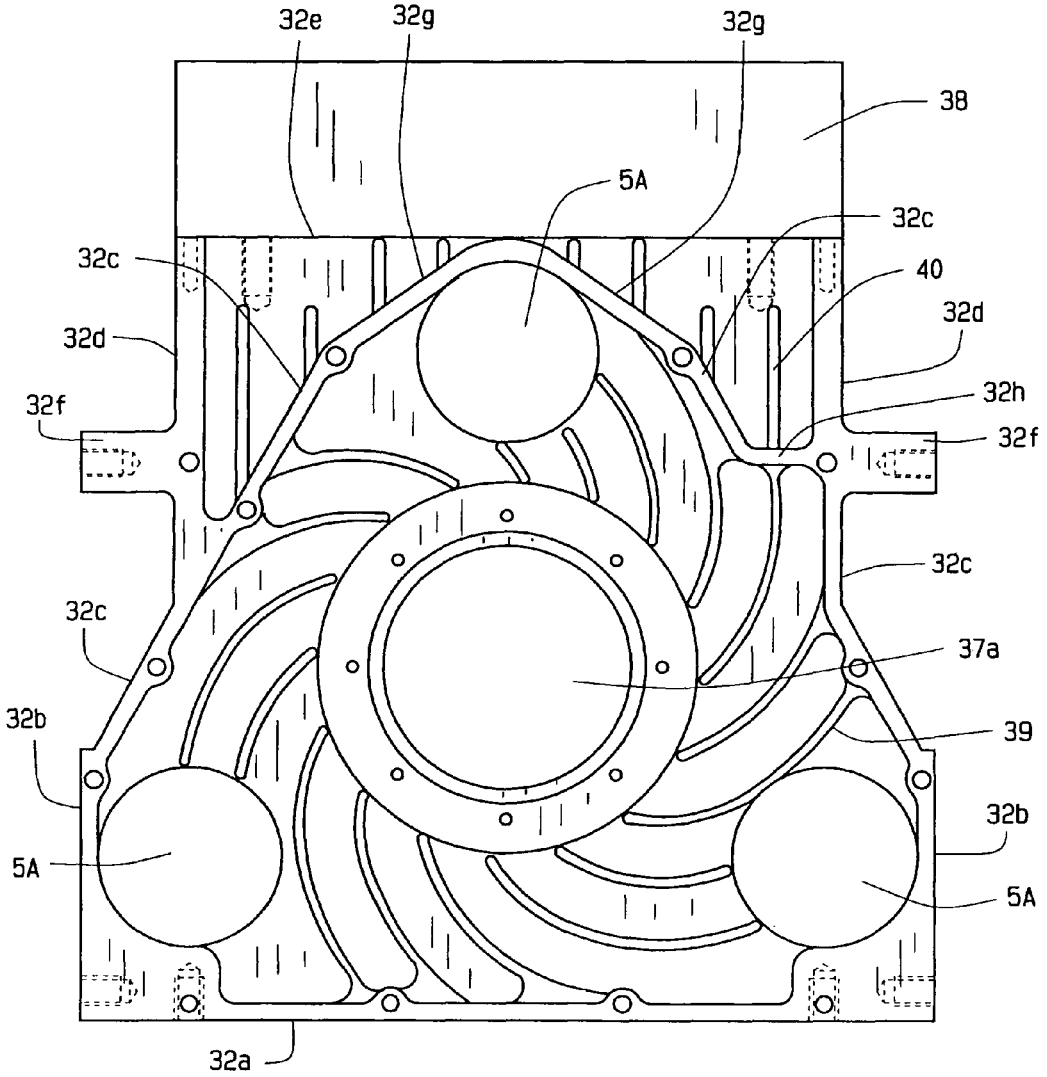
FIG. 8 provides a sectional view of the interior of the housing towards the motor.

FIG. 8 shows a sectional view of the interior of the housing 32 where the housing has internal fins 39 and external fins 40. The housing has a flat bottom 32*a*, two mutually parallel and spaced apart lower sides 32*b*, two inwardly canted middle sides 32*c*, two mutually parallel and spaced apart upper sides 32*d*, and an open top 32*e* generally spanning between the upper sides and mutually parallel to and spaced apart from the bottom. Upon each upper side, the housing has a tapped and threaded fitting 32*f* for receiving bolted devices, not shown. In the preferred embodiment, the internal fins have a generally spiral arrangement however, the internal fins may have alternate shapes of cylindrical or flat plate. The internal fins 39 extend from near the perimeter of the housing inwardly towards the opening 37*a* for the magnetic coupling 37. The internal fins have a generally arcuate shape where the end of the fin proximate the opening is generally ahead of the opposite end of the fin proximate the housing. This arcuate shape forms a generally clockwise spiral. The internal fins 39 are generally narrow in cross section and have a length of at least five times the cross section. The internal fins have a regular spacing between adjacent fins so that no internal fins intersect each other and the internal fins curve towards an imaginary center point at the center of the opening for the magnetic coupling.

The housing has a generally gambrel like shape with a flat bottom 32*a*, lower sides 32*b* perpendicular to the bottom, and inwardly canted middle sides 32*c*. The middle sides continue upwardly within the upper sides and have a section at a second cant 32*g* flatter than the remainder of the middle sides. The second cants 32*g* of the middle sides join upon the center line of the housing above an idler 5. Proximate one side, shown as the right in this figure, the middle side 32*c* extends inwardly and perpendicular to the upper side 32*d* as at 32*h* and there the second cant 32*g* of the middle side extends towards the uppermost idler 5. Within the upper sides 32*d*, the upper middle sides 32*c*, the second cants 32*g*, and the top 32*e* and below the fan 9, the housing has the external fins 40. The external fins extend upwardly from the gambrel like portion of the housing, particularly from the upper middle sides and the second cants. The external fins are generally spaced apart and mutually parallel where the external fins are generally perpendicular to the bottom 32*a* and parallel to the upper sides 32*d*. Each external fin has a narrow cross section and an elongated form with a length in excess of twice the width of the fin.

Figure 9:
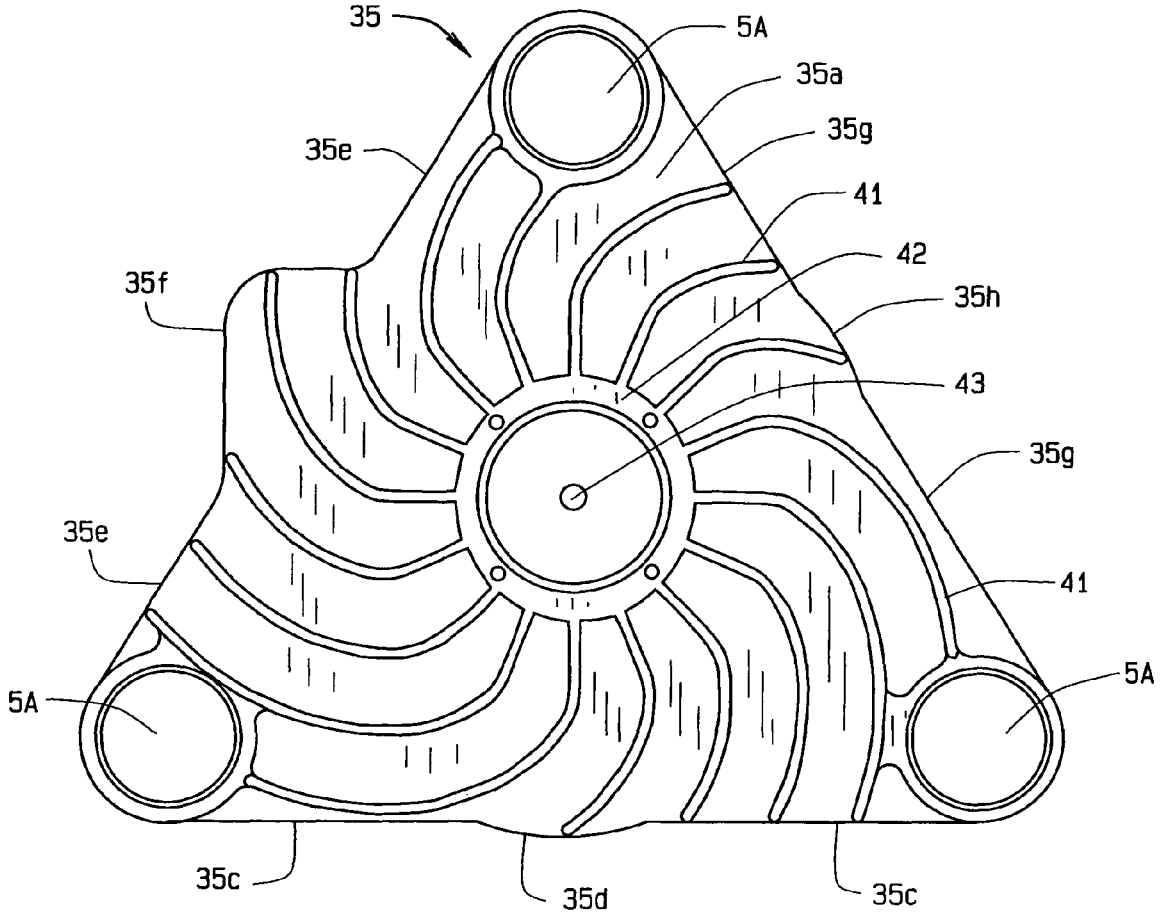
FIG. 9 provides a section view of the back surface of the orbiting scroll where the fins on this back surface engage the fins of the housing as in FIG. 8.

As described above, the housing has internal fins 39 arrayed in a spiral pattern. The internal fins of the housing mesh with the fins extending from the back of the orbiting scroll 35 as shown in FIG. 9. FIG. 9 shows a back face 35*a* of the orbiting scroll that engages the housing. The orbiting scroll has a generally triangular shape defined by the three idlers 5*a* installed at the vertices of the triangular shape. The orbiting scroll has a bottom 35*c* have a generally horizontal orientation, that is parallel to a supporting surface when the invention is installed as in FIG. 7. In the preferred embodiment, the bottom has a slight convex bulge to 35*d* outwardly from the center of orbiting scroll. Proceeding clockwise, the orbiting scroll has a first leg 35*e* extending from above the idler 5 and inwardly from the left of the bottom as shown in this figure. The first leg proceeds upwardly and towards a centerline drawn perpendicular to the center of the bottom. The first leg 35*e* has an extension 35*f* outwardly from the orbiting scroll. The extension 35*f* has a rounded over corner defined by two edges mutually perpendicular with one edge perpendicular to the bottom and the other edge parallel to the bottom. The extension mates with the upper side 32*c* in a similar right angle shape as at 32 of the housing shown in FIG. 8. Above the extension and away from the bottom, the first leg continues to a vertex generally centered above the bottom. Continuing clockwise, at the vertex, the first leg 35*e* wraps around the idler 5 into the second leg 35*g*. The second leg extends from the vertex downwardly and outwardly towards the end of the bottom 35*c* here shown to the right of the figure. Approximately centered along the length of the second leg, another slight convex bulge extends outwardly as at 35*h*. The first leg attains an approximately 60° angle to the bottom, the second leg attains an approximately 60° angle to the first leg, and the bottom attains approximately 60° angle to the second leg.

Upon the back face 35*a*, the orbiting scroll 35 has a plurality of fins 41 arrayed thereon. The fins extend outwardly from an imaginary center of the orbiting scroll towards the bottom, the first leg, and the second leg. Each fin has a narrow cross section and an elongated shape with a length of at least three times the width of the fin. In the preferred embodiment, the internal fins have a generally spiral arrangement however, the internal fins may have alternate shapes of cylindrical or flat plate. These fins 41 extend from near the perimeter, that is the bottom, first leg, and second leg, of the orbiting scroll inwardly towards a circular ring 42 that has an inside diameter proportional to that of the magnetic coupling. The circular ring has at least three holes for securement of the orbiting scroll to the magnetic coupling. These fins 41 have a generally arcuate shape where the end of the fin proximate the circular ring is generally ahead of the opposite end of the fin proximate the perimeter of the orbiting scroll. Proximate the ring 42, each fin approaches the imaginary center of the orbiting scroll upon a radial line. This overall arcuate shape of each fin forms a generally counter-clockwise spiral in this view. These fins 41 have a regular radial spacing between adjacent fins so that fins do not intersect each other. These fins 41 and the internal fins 39 of the housing have sufficient spacing between them to permit motion of the orbiting scroll during usage but without contact between these fins 41 and the internal fins 39. Generally in the center of the ring 42, the orbiting scroll has a plenum 43 here shown on end. The plenum admits working fluid as an internal coolant into the gaps between the orbiting scroll fins 41 and the internal fins 39 of the housing. The plenum provides fluid communication between the back face 35*a* and the front face 35*b* of the orbiting scroll.

Figure 10:
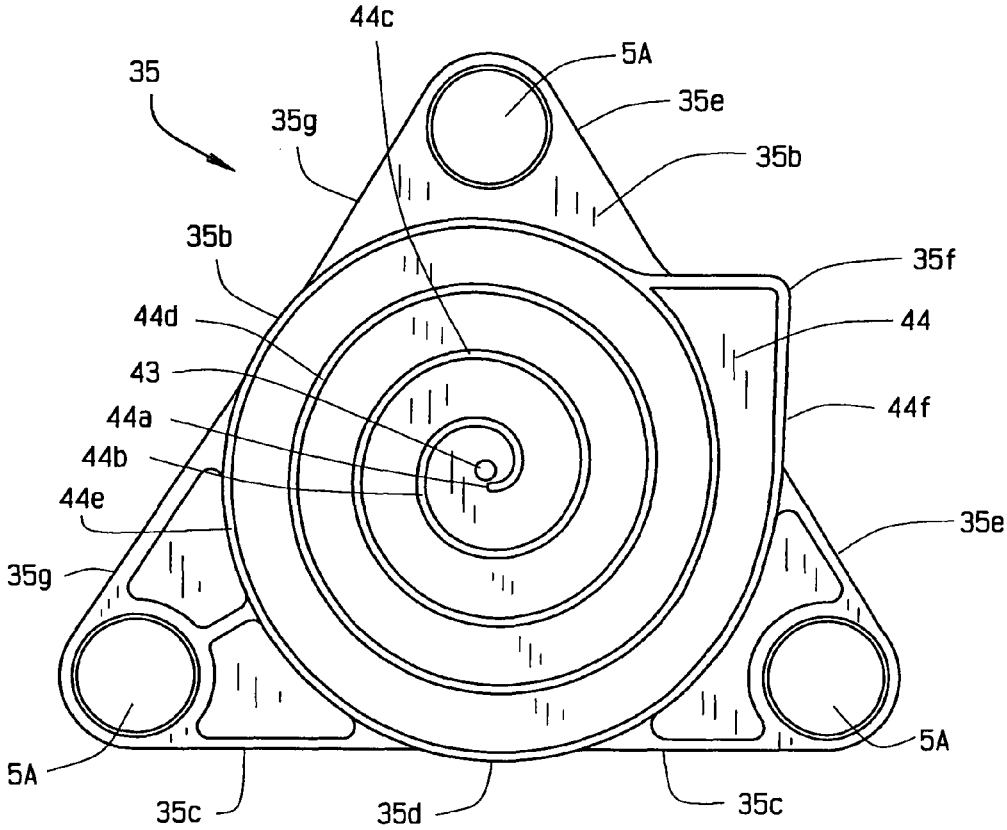

FIG. 10 then shows front face 35*b* an orbiting scroll with an enclosed plenum 43 that prevents the working fluid from mixing with the cooling fluid in the housing 32. This embodiment generally operates where the working fluid and the cooling fluid are the same. Usage of similar fluids accommodates any leakage across the seal of the enclosed plenum 43. Alternatively, the enclosed plenum can be incorporated with the fixed scroll 31, similar to the bellows 22, 23 as previously shown in FIGS. 4, 5. As before, the orbiting scroll has a generally triangular shape defined by the three idlers 5*a* installed at the vertices of the triangular shape. The orbiting scroll has a bottom 35*c* have a generally horizontal orientation, that is parallel to a supporting surface when the invention is installed. In the preferred embodiment, the bottom has a slight convex bulge 35*d* outwardly from the center of orbiting scroll. Proceeding clockwise which is generally opposite that of FIG. 9, the orbiting scroll has the second leg 35*g* that proceeds upwardly and towards a centerline drawn perpendicular to the center of the bottom. Approximately centered along the length of the second leg, another slight convex bulge extends outwardly as at 35*h*. The second leg extends inwardly from the left of the bottom as shown in this figure. The second leg continues to a vertex of the triangular shape generally above the center of the bottom. Continuing clockwise, at the vertex, the second leg 35*g* wraps around the idler 5 into the first leg 35*e*. The first leg 35*e* extends from above the idler 5, downwardly and outwardly towards the right end of the bottom in this figure. The first leg 35*e* has its extension 35*f* outwardly from the orbiting scroll. The extension 35*f* has a rounded over corner defined by two edges mutually perpendicular with one edge perpendicular to the bottom and the other edge parallel to the bottom. The extension mates with the upper side 32*c* in a similar right angle shape as at 32 of the housing previously shown in FIG. 8. The first leg, the second leg, and the bottom each attain approximately 60° angles relative to each other at each vertex of the orbiting scroll. The front face of the orbiting scroll also includes a spiral involute 44. The involute has a generally narrow cross section, an elongated length, and a spacing away from the surface of the front face, generally opposite the internal fins of the back face. The involute begins tangent to the plenum opening, as at 44*a*, generally parallel to the bottom. The involute then curves at a constantly increasing radius as it wraps around the front face. Here the involute completes more than four wraps, 44*b*, 44*c*, 44*d*, and 44*e*, around the plenum where each successive wrap has a greater diameter. The involute, in the fourth wrap 44*e* then extends perpendicular to the bottom as at 44*f*. This extension of the involute fits within the right angle shape 32*c* of the housing upon the first leg as previously described. The radius of the fourth wrap 44 also exceeds the distance from the center of the plenum to the nearest side. Thus, the fourth wrap of the involute extends slightly from the orbiting scroll and occupies the convex bulge 35*d* of the bottom and the convex bulge 35*h* of the second leg.

Figure 11:
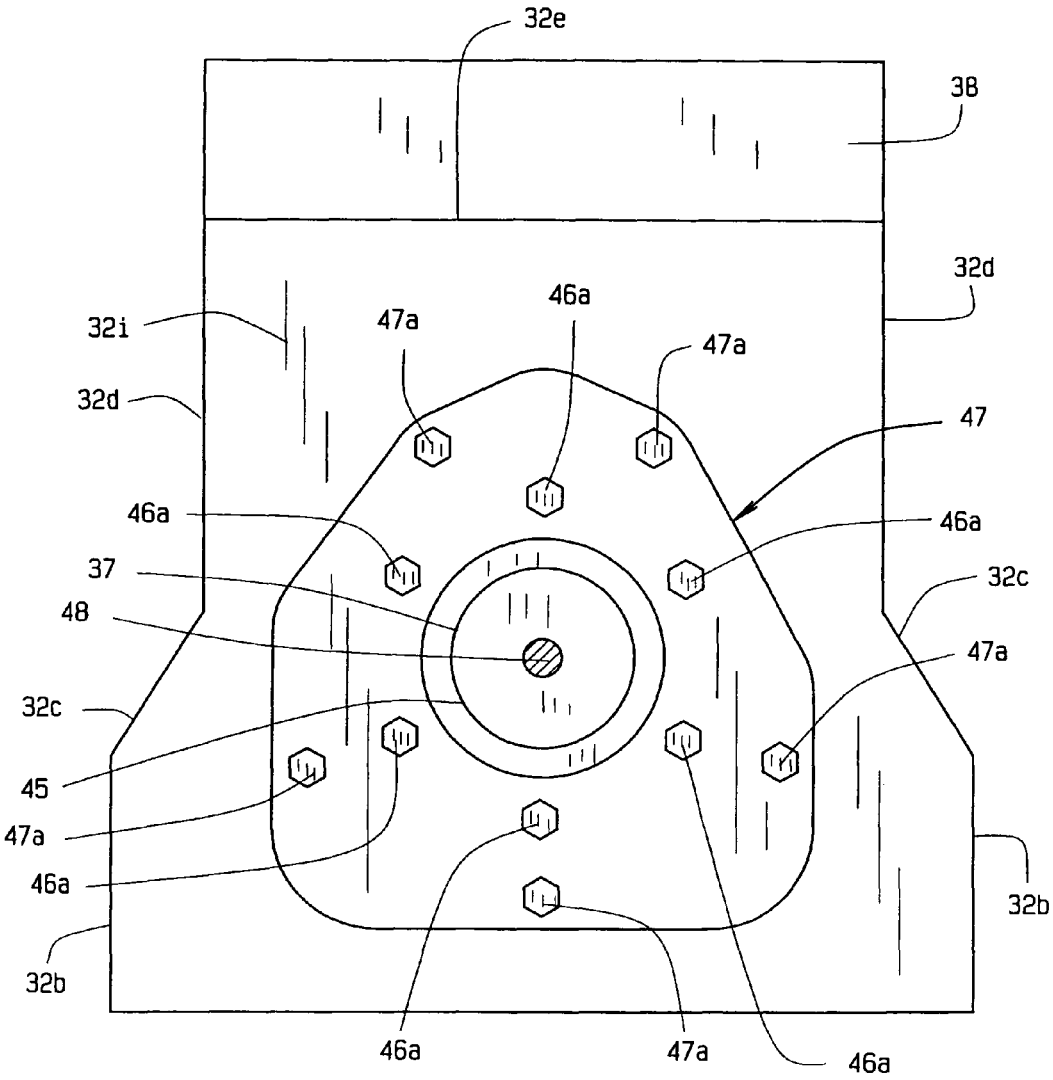
FIG. 11 describes an end view of the housing adjacent to the motor.

FIG. 11 shows the housing 32 upon an end 32*i* that faces the motor 34. The housing has its bottom 32*a*, lower sides 32*b*, middle sides 32*c*, upper sides 32*d*, and top 32*e* as previously described. The fan 38 rests upon the top 32*e* and draws air up, through, and around the housing for air cooling. The end has a generally smooth face. Generally centered between the middle sides, the housing receives an inner rotor 45 concealed within a stationary can 46 of the magnetic coupling 37 as later shown in FIG. 13. The inner rotor then transmits rotation to a compressor shaft 48 that joins to the back surface of the orbiting scroll. Here in FIG. 11, the magnetic coupling has a sealed shroud 47 that has a generally gambrel shape similar to that of the housing but of a lesser scale. The shroud bolts to the exterior surface of the housing, generally opposite the back surface 35*a* of the orbiting scroll as in FIG. 7. The shroud has approximately five bolted connections, as at 47*a*, which secure the shroud to the housing. Within the shroud, the stationary can 46 secures to the housing approximately six is bolted connections as at 46*a*. Both the bolted connections 47*a* of the shroud and the bolted connections 46*a* of the can are mutually parallel and generally parallel to the axis of rotation of the inner rotor 45. The motor 34 generates rotation and torque from its shaft as at 34*a*. The motor shaft 34*a* then drives the magnetic coupling to rotate. The coupling rotates thus transmitting the rotation and torque from the motor shaft into the compressor shaft 48 without a physical connection between the motor shaft and the compressor shaft as later shown.

Figure 12:
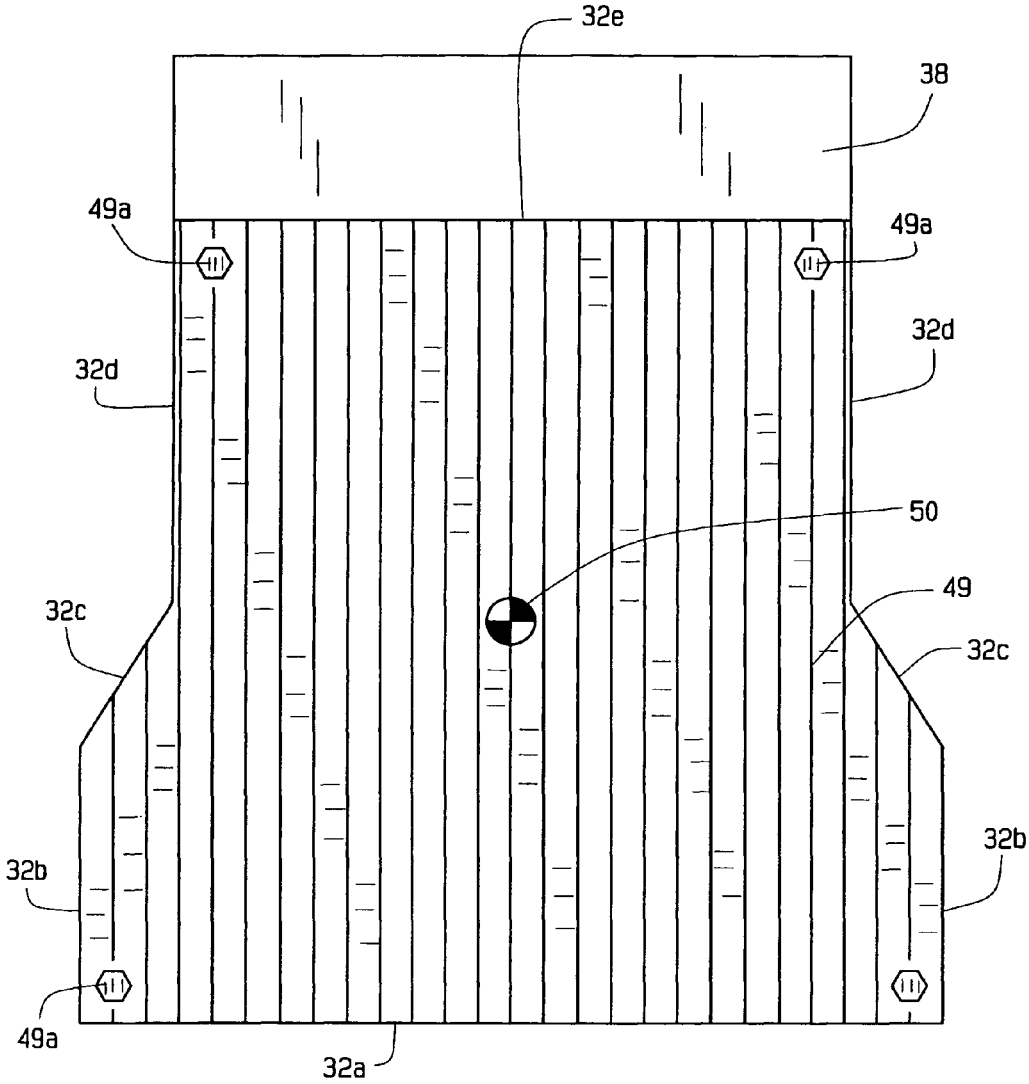
FIG. 12 describes an end view of the housing away from the motor, generally opposite that of FIG. 11.

Turning to the opposite end of the housing as in FIG. 11, FIG. 12 shows the housing end, as at 49, opposite from the motor 34. As previously described, the housing has its bottom 32*a*, lower sides 32*b*, middle sides 32*c*, upper sides 32*d*, and top 32*e* generally in a mirror image as that of FIG. 11. The fan 38 rests upon the top 32*e* and draws air to cool the housing. This end also has a generally smooth face. This end 49 secures to the remainder of the housing use bolted connections as at 49*a* in at least four locations, approximately as shown. Somewhat centered on this end 49, the end has a bearing 50 that receives a shaft from the fixed scroll.

Figure 13:
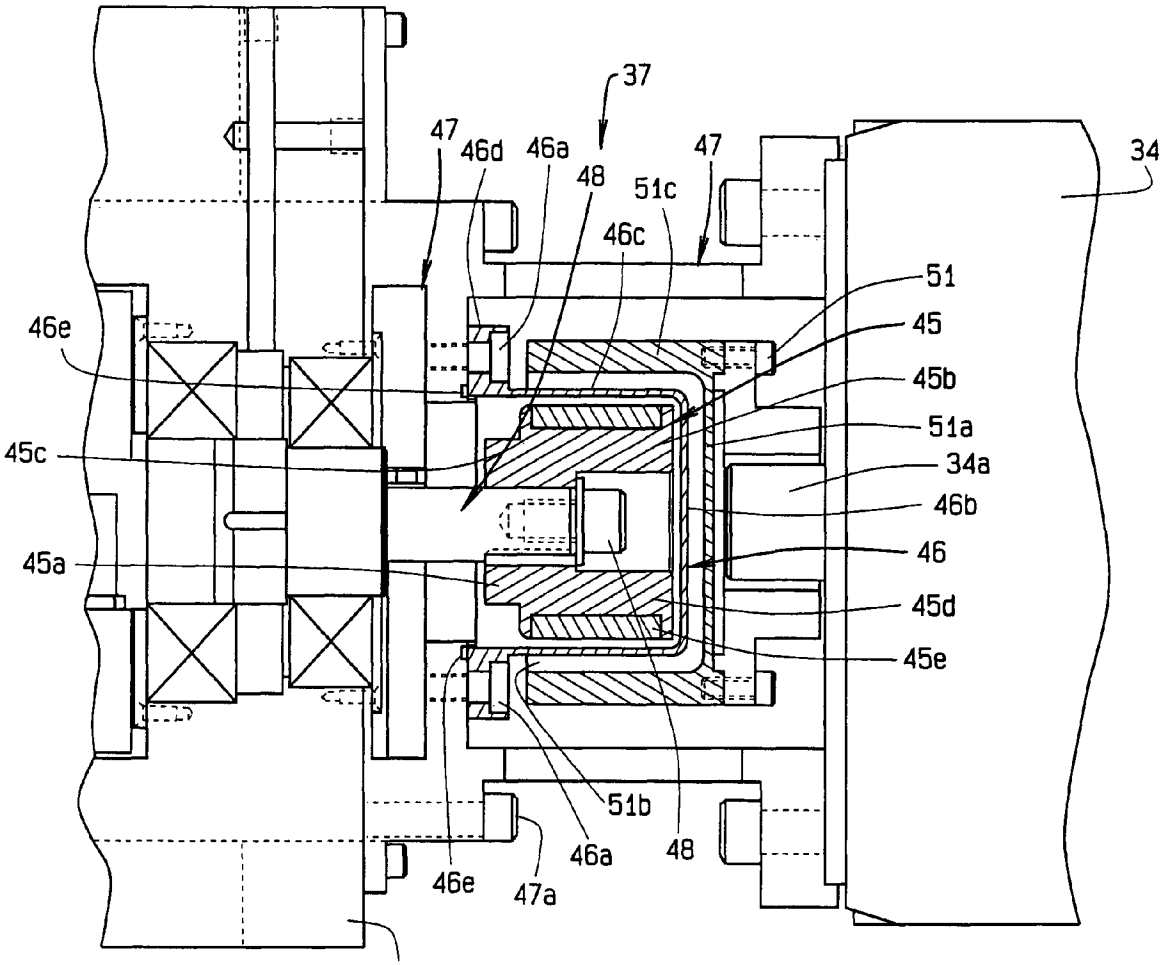
FIG. 13 shows a detailed sectional view of the magnetic coupling between the motor and the orbiting scroll within the housing.

As mentioned briefly in FIG. 11, the motor 34 delivers rotation and torque to the orbiting scroll through a magnetic coupling 37 shown in a section view in FIG. 13. The coupling transmits rotation and torque from the motor shaft 34*a* to the compressor shaft 48 without a physical connection between the two shafts. Rather the coupling uses a magnetic field put into rotation to transmit rotation and torque from one shaft to another. Because the magnetic field penetrates steel and plastic, the coupling transmits rotation and torque between the shafts while the compressor shaft remains sealed within the stationary can 46. Sealing the compressor shaft retains the airing fluid and the working fluid within the housing 32 and prevents intrusion of the atmosphere along the compressor shaft to into the housing. As before, the magnetic coupling 37 has a shroud 47 that extends between the motor 34 and the housing 32 and enwraps the coupling. The shroud bolts on its own opposite ends to both the motor and the housing as shown and described. Inside the shroud 47, the motor extends its shaft 34*a* within the shroud towards the adjacent housing.

The shaft has secured to it an outer rotor 51 here shown as a generally U shape in section view. The outer rotor has a generally round cylindrical shape with a closed end 51*a* adjacent to the shaft 34*a* and an opposite open end as at 51*b* proximate the housing. The outer rotor has a generally curved wall 51*c* extending perpendicular to the perimeter of the closed end. The outer rotor has its own magnetic polarity and its own inside diameter.

Inside of the outer rotor, the magnetic coupling has a stationary can 46 that secures to the housing 32 through its bolts as at 46*a*. The stationary can is also a generally round cylinder, shown here as a U shape in section view, with a closed end 46*b*, an opposite open end 46*c*, and a thin wall 46*c* that expands outwardly into a flange 46*d* for receiving bolts 46*a* adjacent to the housing. The stationary can also includes an O-ring or gasket as at 46*e* upon its circumference upon the interior of the flange 46*d* that seals the stationary can upon the housing and prevents intrusion of the atmosphere into the housing. The stationary can has an outside diameter less than the inside diameter of the outer rotor and limited effect on the magnetic field of the outer rotor.

Then inside of the stationary can, the magnetic coupling has its inner rotor 45 generally coaxial with the compressor shaft and mechanically secured to the compressor shaft. The inner rotor is a somewhat round cylinder with a recess at its base, here shown as a thickened U shape with an extension at the base of the U shape. The inner rotor has an open end 45*b* and an opposite closed end 45*a* with an extension 45*c* recessed in from the wall 45*d* forming the inner rotor. The wall 45*d* is generally thick, much thicker in comparison to the walls of the stationary can and the outer rotor. In the alternate embodiment, the entire inner rotor has a magnetic polarity opposite that of the outer rotor. The opposite polarities attract the inner rotor to rotate in the direction of the outer rotor. Alternatively, the inner rotor is magnetically neutral and includes a magnetic band 45*e* around the perimeter of the inner rotor and extends for substantially the length of the wall 45*d*. The magnetic band has an opposite magnetic polarity to the outer rotor. The inner rotor has an outer diameter less than the inside diameter of the stationary can. So, turning of the outer rotor by the motor causes the inner rotor to turn in the same direction through magnetic attraction without a physical connection of the motor shaft to the compressor shaft. Additionally because the motor turns magnetized parts within the magnetic coupling, the housing, the motor, and the coupling are grounded to dissipate any electrical charge created by the rotating magnetic parts.

Figure 14:
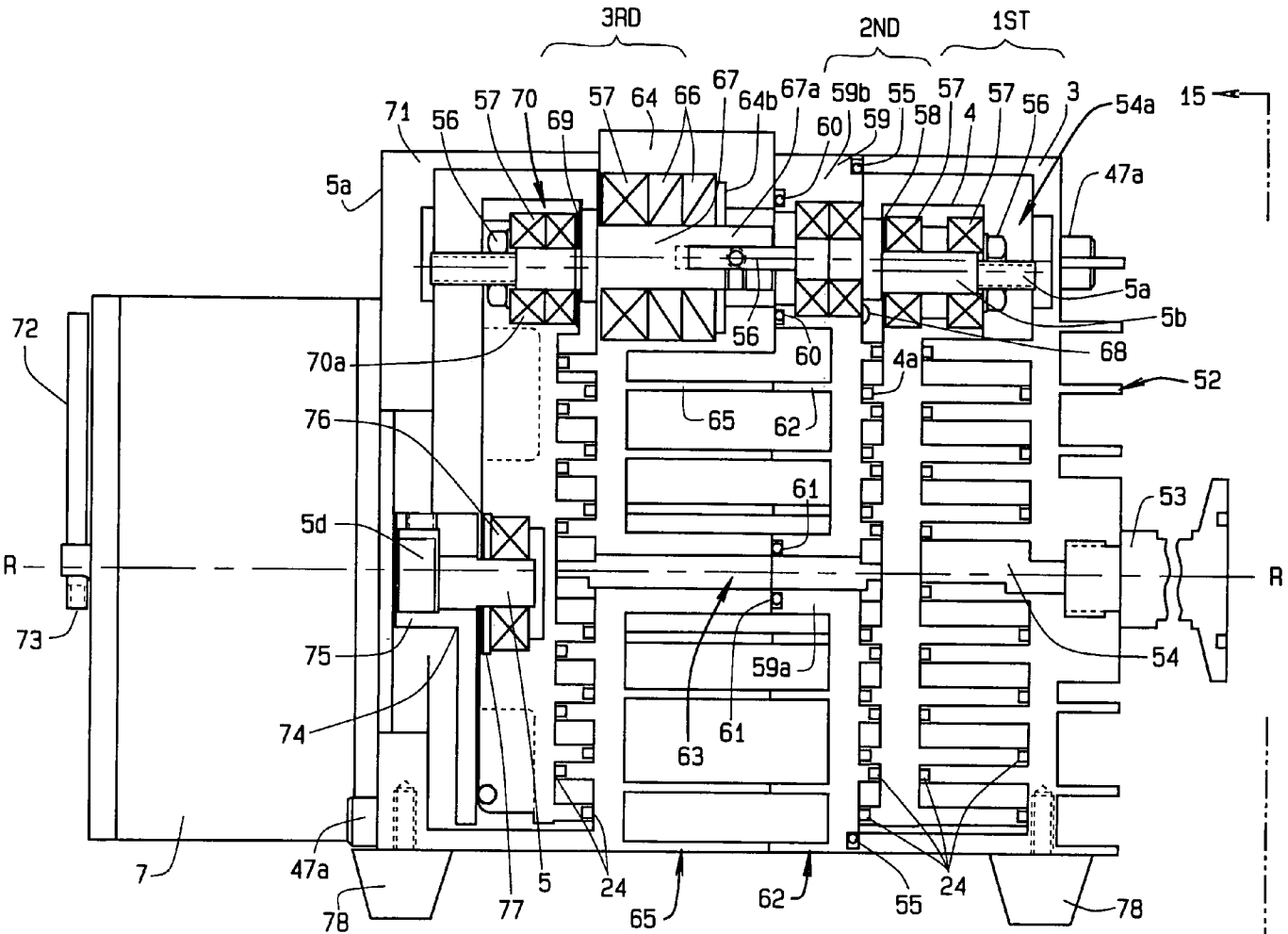
FIG. 14 shows a sectional view lengthwise through the three stage vacuum pump.

Moving to the present invention of the three stage vacuum pump, FIG. 14 shows this pump in a sectional view lengthwise. The pump begins with its first fixed scroll 3 having a plurality of fins 52 extending outwardly from the invention and generally opposite the scroll itself. Generally centered within the fins 52, the first fixed scroll has a vacuum fitting 53 for connection to a space, hose, or device that is to be evacuated. The vacuum fitting leads to a passage 54 extending into the first fixed scroll that admits any gas molecules into the center of the scroll. The first fixed scroll has an expanding spiral shape, here shown on edge, that directs any gas molecules outwardly. The first fixed scroll allows a first orbiting scroll 4 to intermesh with it. The first orbiting scroll rotates within the first fixed scroll directing any gas molecules outwardly from the center of both scrolls towards an edge of the scrolls. The first orbiting scroll 4 operates upon three idlers 5*a* generally arranged in an equi-angular manner. This figure shows one idler 5*a* proximate the top of the fixed scroll 3. The idler operates upon a first eccentric shaft 5*b* supported upon bearings 57 as shown. A bearing nut 56 secures the bearings upon the eccentric shaft while permitting the shaft to rotate axially. As described, the first fixed scroll and the first orbiting scroll define the first stage of this three stage vacuum pump.

The orbiting scroll 4 also has a second scroll 4*a* upon its inward surface, that is, opposite the first fixed scroll. Inwardly from the first orbiting scroll, a second fixed scroll intermeshes with the scroll 4*a*. The second fixed scroll 59 cooperates with the second scroll 4*a* of the first orbiting scroll 4 to compress any gas molecules beginning at the periphery of the second scroll and directly them inwardly towards the center of the second fixed scroll. The second scroll 4*a* and the second fixed scroll 59 form the second stage of this three stage vacuum pump.

The first fixed scroll 3, the first orbiting scroll 4, the second scroll 4*a*, and the second fixed scroll 59 each have tip seals 24 along the entire lengths of each scroll respectively. The tip seal prevents escape of any gas molecules between adjacent scrolls as the orbiting scroll and second scroll intermesh with their respective fixed scrolls. One version of a tip seal has been previously shown in FIG. 6.

The idlers, as at 5*a*, also pass through the second fixed scroll 59. In doing so, the eccentric shaft 5*b* has a centerline off center from its centerline passing through the first fixed scroll. Where the eccentric shaft fits into the first orbiting scroll, a shim 58 occupies any gap between the nearest bearing 57 in the first orbiting scroll and the eccentric shaft. Opposite the shim as shown, a screw 68 compresses the bearings 57 into the second fixed scroll. The first fixed scroll seals to the second fixed scroll proximate its exterior perimeter using a O-ring as at 28.

Opposite its involute, the second fixed scroll 59 has a plurality of fins 62 generally parallel to the exterior fins 52. These fins 62 have a depth greater than the depth of the involute of the fixed scroll and approximately the same depth as the exterior fins 52. Generally centered upon the fixed scroll 59, the involute opens at the center of the second fixed scroll to a center passage 63 within a hollow stub 59*a*. The hollow stub has a thickness generally greater than the fins 62. Outwardly from the stub, the second fixed scroll has three sockets 59*b* spaced equiangular that receive the idlers 5*a*. As later shown, the three stage vacuum pump has a generally triangular shape when viewed from its end. The idlers locate proximate the vertices of the triangular shape.

Slightly outward from the socket 59*b*, the first fixed scroll 3 abuts the second fixed scroll 59. An O-ring, as at 60, seals these two scrolls upon their mutual perimeter. Then proximate the base of the sockets 59*b*, opposite the orbiting scroll 4, each idler has an O-ring 60 that seals it to a third fixed scroll 64. The stub 59*a* also has an O-ring 61 that seals it to the third fixed scroll so that the center passage 63 continues and does not leak any gas molecules into the center passage.

The third fixed scroll 64 generally aligns with the second fixed scroll 59 as shown, in the center of FIG. 14. The third fixed scroll has a plurality of fins 65 that align to the fins 62 of the second fix scroll. The fins 65 generally have a butt to butt facing with the fins 62. The third fixed scroll has a tube 64*a*, generally hollow, that abuts the stub 59*a* of the second scroll and the center passage 63 continues through the tube. Outwardly from the tube 64*a*, the third fixed scroll has its sockets 64*b* that receive the idlers 5*a*. The idlers in the third fixed scroll have an eccentric shaft 67 having a socket 67*a* that receives an end, as at 5*c*, of the eccentric shaft 5*b* from the first and second stages of this pump. The eccentric shaft 67 of the third fixed scroll 64 has seals 66 that partially fill each socket 67*a* away from the second stage. Upon the seals, each idler has a bearing 57, generally opposite the fins 65 and proximate the scroll work of the third fixed scroll. Opposite the fins 65, the third fixed scroll has its involute. The involute begins where the center passage 63 opens through the third fixed scroll. The involute then expands outwardly in a spiral like pattern.

The involute of the third fixed scroll 64 then intermeshes with involute from a second orbiting scroll 70. The scroll work of the second orbiting scroll generally aligns with the scrolls of the first orbiting scroll 4 and its second scroll 4*a*. The second orbiting scroll rotates within the third fixed scroll 64 so that any gas molecules entering the second orbiting scroll from the center passage 63 migrate outwardly along the intermeshed scroll which then exhausts the molecules from the invention. Outwardly from the center passage, the second orbiting scroll 70 has a socket 70*a* that receives the bearings 57 of the eccentric shaft 67 of the idler 5*a*. A bearing nut 56 outwardly from the bearings 57, that is, opposite the third fixed scroll 64, secures the bearings and the shaft within the socket 70*a*. Opposite the bearing nut, a shim 69 fits the bearings 57 against the eccentric to shaft. The second orbiting scroll 70 and the third fixed scroll 64 form the third stage of this three stage vacuum pump. As with the first and second stages, the third fixed scroll 64 and the second orbiting scroll 70 each have tip seals 24 along the entire lengths of each scroll respectively, as previously shown in FIG. 6. The tip seals form a gas tight chamber as the scrolls intermesh.

Proximate the center passage and off center from the center passage, here shown downwardly in FIG. 14, the second orbiting scroll includes an inner bearing race 76 that admits an eccentric driving pin 5. The eccentric driving pin extends outwardly from the second orbiting scroll 70 through a sealing disc 77 placed upon the bearing race opposite the center passage 63. The eccentric driving pin is generally round and extends outwardly from the second orbiting scroll to a round shaft 5*d*. Thought the shaft 5*d* is round, the eccentric driving pin joins to the shaft 5*d* off center. The off center arrangement of the eccentric driving pin allows the shaft to rotate about an axis coaxial with the center passage while inducing an orbital rotation to the second orbiting plate 70 which induces rotation of the idlers 5*a* in the third stage transmitted through the shaft 67 to the idlers 5*a* in the second and first stages. The shaft 5*d* in its rotation induces both orbiting scrolls to orbit at the same time. Downwardly and outwardly from the driving pin 5 and the round shaft 5*d*, a crankshaft 74 extends towards the bottom of the invention, generally towards a foot 78. The crankshaft has an inverted L shape as shown where the flange of the L shape adjoins the driving pin and the round shaft and web of the L shape extends outwardly from the driving pin. The web is generally thin and of a length so that the crankshaft avoids colliding with the idler 5*a* towards the top of this figure and the housing towards the bottom of this figure. The crankshaft includes its setscrew 75 that secures it to the round shaft.

Outwardly from the shaft 5*d*, a housing 71 encloses the second orbiting scroll 70, driving pin 5 and round shaft 5*d*. The housing 71 cooperates with the fins 65 of the third fixed scroll, the fins 62 of the second fixed scroll 59, and the first scroll 3 to enclose the invention. Bolts 47*a* secure the housing 71 and the first scroll 3 together with the second fixed scroll and third fixed scroll between them. Feet 78 extend downwardly from the housing 71 and the first scroll 3.

Having described the round shaft as rotating, the round shaft 5*d* extends from a motor 7 joining to the housing 71 outwardly from the remainder of the invention. The round shaft and the remainder of the motor have an axis of rotation R-R centered upon the center passage 63 as shown. The motor 7 has sufficient horsepower and torque to rotate the first orbiting scroll and the second orbiting and suitable revolutions per minute to evacuate any gas molecules that enter the vacuum fitting 53. The motor moving the three stages of scrolls produce vacuums of approximately 2 milli-torr. Because the motor turns the eccentric driving pin 5, the motor includes a counterweight 72 connected to the round shaft 5*d* opposite the housing. The counterweight is generally linear and placed at an angle opposite the driving pin and the crankshaft. The counterweight counteracts the angular momentum of the driving pin and the two orbiting scrolls thus minimizing vibrations generated by the invention. A set screw 73 allows for adjusting the position of the counterweight relative to the axis R-R of rotation of the motor 7.

Figure 15:
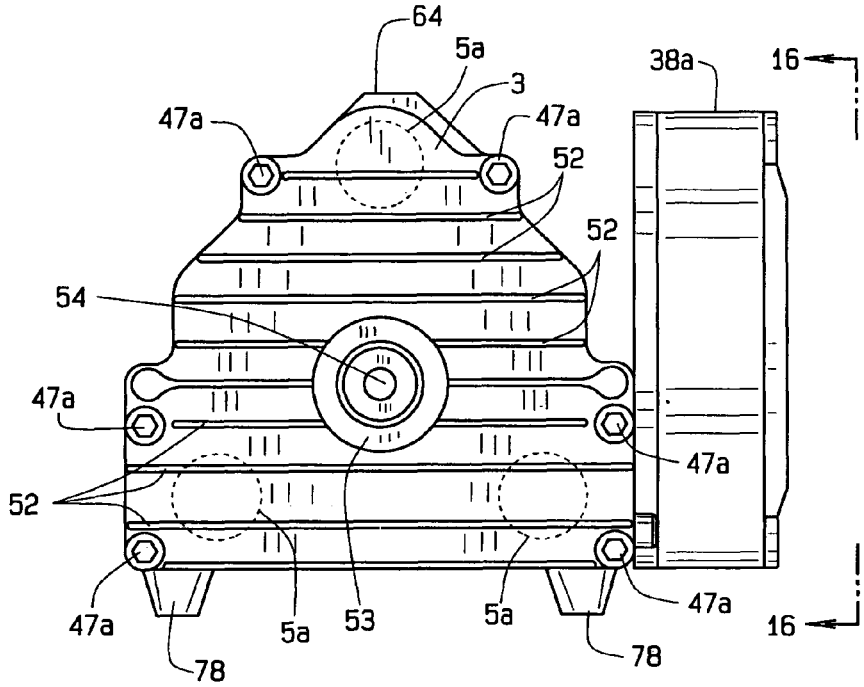
FIG. 15 provides an end view of the three stage vacuum pump.

Having described the invention from its vacuum fitting along the flow path of the center passage back to the motor driving the orbiting scrolls through idlers, we turn to an exterior end view of the invention in FIG. 15. The invention has a somewhat triangular shaped end upon two feet 78 with the vacuum fitting 32 shown generally centered and the passage 54 centered inside of the fitting. Outwardly from the vacuum fitting, this end view shows the exterior of the first fixed scroll 3 that has a plurality of horizontal fins 52 generally parallel to a plane defined by the feet 78. The fixed scroll connects to the remainder of the invention upon a plurality of bolts 47*a* here shown as two proximate the feet, two outwardly from the vacuum fitting, and two more bolts proximate the top of the fixed scroll outwardly and beneath the curved top. Behind the curved top as shown, the top of the second fixed scroll 64 appears. Towards the right of the invention in this figure, that is, opposite the view of FIG. 14, the invention has a fan 38 encased within a guard 38*a*. The fan generally extends for the length of the three stages of scrolls as later shown. The fan draws air around the scrolls and through the fins 62, 65 where the second and third fixed scrolls 59, 64 join. This air flow provides cooling as the various scrolls extract heat during their formation of higher order vacuums.

Figure 16:
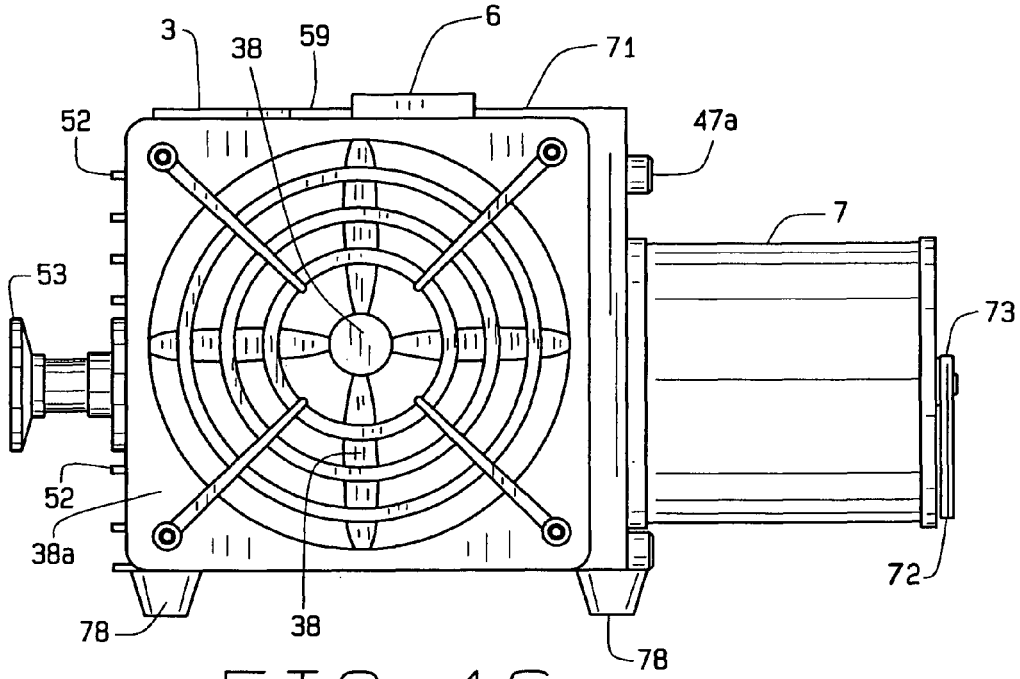
FIG. 16 describes a side view of the three stage vacuum pump.

Turning the invention again, FIG. 16 shows the invention opposite that of FIG. 14 from the exterior. The invention has the vacuum fitting 32 upon the left, here shown as a flange connecting through a narrower tube to the first fixed scroll 3. The fixed scroll has its fins 52, here shown on end, and extending perpendicular to the center passage 54. The first fixed scroll 3 adjoins the second fixed scroll 59 which adjoins the third fixed scroll 64 and which adjoins the housing 71 as shown across the top of the fan 38 from left to right. The scrolls and housing are secured upon each other using bolts 47*a* that extend through each of the scrolls and the housing. Beneath the fan, feet 78 support the first fixed scroll and the housing respectively. The fan extends along the three fixed scrolls and draws air across and through them for cooling. Opposite the vacuum fitting, the motor 7, with its counterweight 72, provides balance rotational power through its driving pin to the orbiting scrolls and idlers as previously described.

Figure 17:
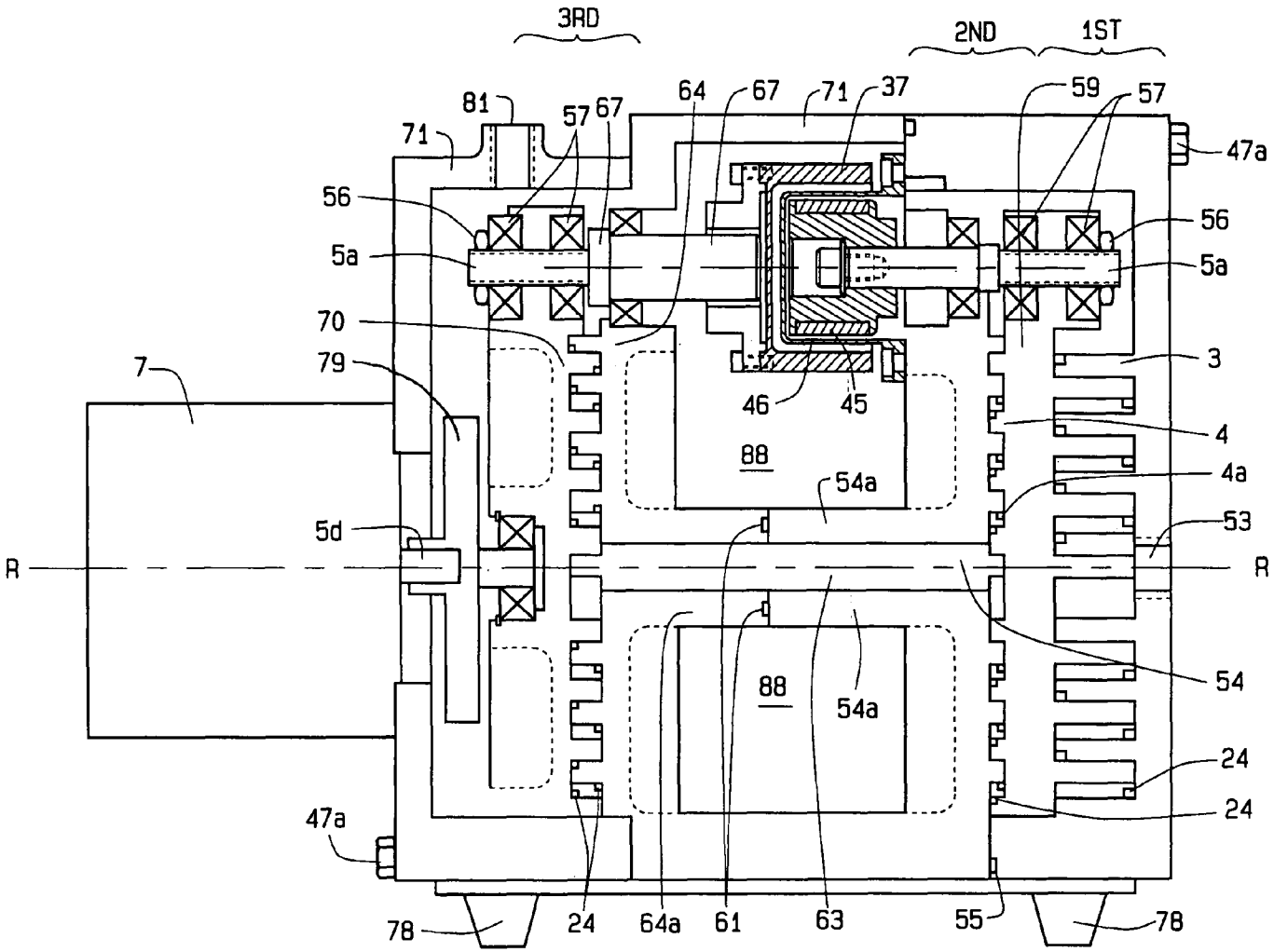
FIG. 17 illustrates a sectional view lengthwise of the three stage vacuum pump utilizing a magnetic coupling.

Moving to an alternate embodiment of the present invention of the three stage vacuum pump, FIG. 17 shows a sectional view lengthwise. The pump begins with its first fixed scroll 3 having a smooth exterior face outwardly from the invention. Generally centered within the fixed scroll 3, a vacuum fitting 53 provides a connection to a space, hose, or device that is to be evacuated. The vacuum fitting leads to a passage 54 extending into the first fixed scroll that admits any gas molecules into the center of the fixed scroll away from the space to be evacuated. The first fixed scroll has an expanding spiral shape, here shown on edge, that directs any gas molecules outwardly. The first fixed scroll allows a first orbiting scroll 4 to intermesh with it. The first orbiting scroll rotates within the first fixed scroll directing any gas molecules outwardly from the center of both scrolls towards an edge of the scrolls. The first orbiting scroll 4 operates upon three idlers 5*a* generally arranged in an equi-angular manner. This figure shows one idler 5*a* proximate the top of the fixed scroll 3. The idler operates upon a first eccentric shaft 5*b* supported upon bearings 57 as shown. A bearing nut 56 secures the bearings upon the eccentric shaft while permitting the shaft to rotate axially. As described, the first fixed scroll and the first orbiting scroll define the first stage of this three stage vacuum pump.

The orbiting scroll 4 also has a second scroll 4*a* upon its inward surface, that is, opposite the first fixed scroll. Inwardly from the first orbiting scroll, a second fixed scroll intermeshes with the scroll 4*a*. The second fixed scroll 59 cooperates with the second scroll 4*a* of the first orbiting scroll 4 to compress any gas molecules beginning at the periphery of the second scroll and directing them inwardly towards the center of the second fixed scroll. The second scroll 4*a* and the second fixed scroll 59 form the second stage of this three stage vacuum pump. As before, the first fixed scroll 3, the first orbiting scroll 4, the second scroll 4*a*, and the second fixed scroll 59 each have tip seals 24 along the entire lengths of each scroll respectively.

The idlers, as at 5*a*, also pass through the second fixed scroll 59. In doing so, the eccentric shaft 5*b* has an offset centerline from a centerline passing through the first fixed scroll. The first fixed scroll seals to the second fixed scroll proximate its exterior perimeter using a O-ring as at 28.

Opposite its involute, the second fixed scroll 59 adjoins to chambers 80 forming a generally annular volume within this embodiment suitable for cooling the three stages. Generally centered upon the fixed scroll 59 and within the chambers 80, the involute opens at the center of the second fixed scroll to a center passage 63 within an elongated stub 59*a*, longer than the stub shown in FIG. 14. This elongated stub has a thickness slightly more than that of the second fixe scroll. Outwardly from the stub, the second fixed scroll has three sockets 59*b* spaced equiangular that receive the idlers 5*a*. As previously shown, this alternate embodiment of the three stage vacuum pump also has a generally triangular shape when viewed on end. The idlers locate proximate the vertices of the triangular shape.

Towards the interior of this embodiment, the second fixed scroll 59 abuts the third fixed scroll 64. The third fixed scroll has an elongated stub 64*a* that aligns with the elongated stub 59*a* of the second fixed scroll forming a continuous center passage from the second stage into the third stage of this embodiment of the pump. The stub 59*a* also has an O-ring 61 that seals it to the third fixed scroll so that the center passage 63 continues and does not leak any gas molecules into the center passage. An O-ring, as at 55, seals the first fixed scroll to the second fixed scroll upon their mutual perimeter. The third fixed scroll 64 generally aligns with the second fixed scroll 59 as shown upon a common axis defined by the center passage 63, in the center of FIG. 17. The third fixed scroll locates away from the joint of the elongated tubes 59*a*, 64*a* so that the chambers 80 have a generally rectangular shape in section view as here shown.

As shown in FIG. 17 and above the center passage, outwardly from the tube 64*a*, the third fixed scroll has its sockets 64*b* that receive the idlers 5*a*. The idlers in the third fixed scroll have an eccentric shaft 67 that extends into a magnetic coupling 37. Generally centered between the second stage and the third stage, the housing 71 receives an inner rotor 45 concealed within a stationary can 46 of the magnetic coupling 37 as later shown in FIG. 18. The inner rotor then transmits rotation to eccentric shaft 5*b* that rotates the first orbiting scroll. In usage, the magnetic coupling receives rotation and torque through the eccentric shaft 67. The coupling rotates thus transmitting the rotation and torque from the motor shaft into the eccentric shaft through the first and second stages of this pump without a mechanical connection as in the preferred embodiment of the three stage pump.

The eccentric shaft 67 of the third fixed scroll 64 has seals 66 that partially fill each socket 67*a* away from the second stage. Upon the seals, each idler has a bearing 57, generally opposite the chambers 80 and proximate the scroll work of the third fixed scroll 64. Opposite the chambers and the magnetic coupling, the third fixed scroll has its involute. The involute begins where the center passage 63 opens through the third fixed scroll. The involute then expands outwardly in a spiral like pattern.

The involute of the third fixed scroll 64 then intermeshes with involute from a second orbiting scroll 70. The scroll work of the second orbiting scroll generally aligns with the scrolls of the first orbiting scroll 4 and its second scroll 4*a*. The second orbiting scroll rotates within the third fixed scroll 64 so that any gas molecules entering the second orbiting scroll from the center passage 63 migrate outwardly along the intermeshed scroll which then exhausts the molecules from the invention through an outlet 81. Outwardly from the center passage, the second orbiting scroll 70 has a socket 70*a* that receives the bearings 57 of the eccentric shaft 67 of the idler 5*a*. A bearing nut 56 outwardly from the bearings 57, that is, opposite the third fixed scroll 64, secures the bearings and the shaft within the socket 70*a*. Opposite the bearing nut, a shim 69 fits the bearings 57 against the eccentric shaft 67 if needed. The second orbiting scroll 70 and the third fixed scroll 64 form the third stage of this three stage vacuum pump. As with the first and second stages, the third fixed scroll 64 and the second orbiting scroll 70 each have tip seals 24 along the entire lengths of each scroll respectively, as previously shown in FIG. 6. The tip seals form a gas tight chamber as the scrolls intermesh.

Aligned with the center passage 63, the second orbiting scroll includes a bearing 14 that admits a drive pin 8, generally round and cylindrical. The drive pin extends outwardly from the second orbiting scroll 70 through a sealing disc 77 if needed. The drive pin extends outwardly and to a flywheel 79 generally centered upon the center passage. The flywheel has its diameter generally perpendicular to the center passage and a thickness slightly less than the length of the drive pin 8. The flywheel provides for steady rotation of the second orbiting scroll once operating revolutions have been reached. The flywheel has its central hub that connects with the round shaft 5*d* that rotates about an axis coaxial with the center passage while inducing an orbital rotation to the second orbiting plate 70 which induces rotation of the idlers 5*a* in the third stage transmitted through the shaft 67 to the magnetic coupling and then the idlers 5*a* in the second and first stages. The shaft 5*d* in its rotation induces both orbiting scrolls to orbit at the same time.

Outwardly from the shaft 5*d*, a housing 71 encloses the second orbiting scroll 70, driving pin 8, flywheel 79, and round shaft 5*d*. The housing 71 cooperates with the elongated stubs 59*a*, 64*a*, chambers 80, and first fixed scroll 3 to enclose the invention. Bolts 47*a* secure the housing 71 and the first scroll 3 together with the second fixed scroll and third fixed scroll between them. Feet 78 extend downwardly from the housing 71 and the first scroll 3.

Having described the round shaft as rotating, the round shaft 5*d* extends from a motor 7 joining to the housing 71 outwardly from the remainder of the invention. The round shaft and the remainder of the motor have an axis of rotation centered upon the center passage 63 as shown. The motor 7 has sufficient horsepower and torque to rotate the first orbiting scroll and the second orbiting at suitable revolutions per minute through the magnetic coupling 37 to evacuate any gas molecules that enter the vacuum fitting 53. The motor moving the three stages of scrolls produce vacuums of approximately 2 milli-torr but without mechanical connection between the second stage and the third stage. The motor 7 generates rotation and torque from its shaft as at 5*d* that turns the flywheel 79 that turns the drive pin 8 into the second orbiting scroll 70 which turns the shaft 67 that rotates an outer rotor 51 that induces rotation of the inner rotor 45 that then turns the idler shaft 5*a* in the second and first stages.

Figure 18:
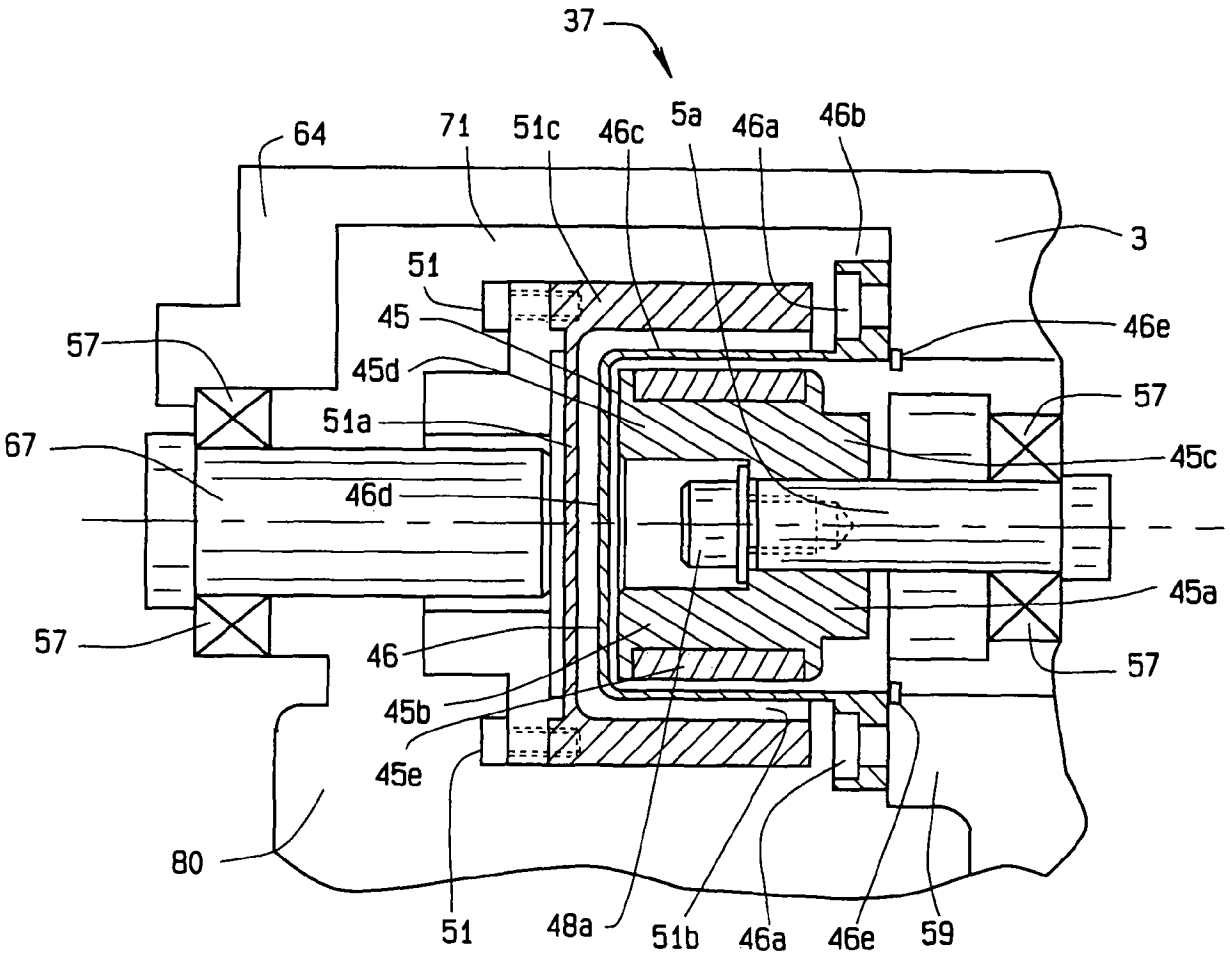
FIG. 18 provides a detailed sectional view of the magnetic coupling between the third stage and the second stage of this pump.

As mentioned briefly in FIG. 17, the motor 7 delivers rotation and torque to the second orbiting scroll 64 then into the eccentric shaft 67 of an idler 5*a* connected to a magnetic coupling 37 shown in a section view in FIG. 18. FIG. 18 is somewhat of a mirror image from FIG. 13. The coupling transmits rotation and torque from the round shaft 5*d* through the flywheel, second orbiting scroll, into the eccentric shaft 67 to the idler shaft 5*a* proximate the second fixed scroll 59 without a physical connection between the two shafts. Rather the coupling uses a magnetic field put into rotation to transmit the rotation and torque from one shaft to another. Because the magnetic field penetrates steel and plastic, the coupling transmits rotation and torque between the shafts while the idler shaft 5*a* of the second fixed scroll remains sealed within the stationary can 46. Sealing the idler shaft retains the partial vacuum created in the first and second stages and allows any remaining molecules to solely exit through the center passage 63. Sealing the idler shaft also prevents intrusion of the atmosphere into the first and second stages. The magnetic coupling 37 in this embodiment is located within the housing 71, above the center passage 63, and inside of the second fixed scroll 59.

The eccentric shaft 67 has secured to it an outer rotor 51 here shown as a generally U shape, rotated clockwise, in section view. The outer rotor has a generally round cylindrical shape with a closed end 51*a* adjacent to the eccentric shaft 67 and an opposite open end as at 51*b* proximate the second fixed scroll. The outer rotor has a generally curved wall 51*c* extending perpendicular to the perimeter of the closed end. The outer rotor has its own magnetic polarity and its own inside diameter.

Inside of the outer rotor, the magnetic coupling has a stationary can 46 that secures to the first fixed scroll 3, generally towards the top of this figure, and the second fixed scroll 59 generally in the direction of the center passage 63 through its bolts as at 46*a*. The stationary can is also a generally round cylinder, shown here as a U shape rotated ninety degrees clockwise in section view, with a closed end 46*b*, an opposite open end proximate 46*d*, and a thin wall 46*c* that expands outwardly into a flange 46*d* for receiving bolts 46*a* adjacent to the housing. The stationary can also includes an O-ring or gasket as at 46*e* upon its circumference upon the interior of the flange 46*d* that seals the stationary can upon the second fixed scroll and prevents intrusion of the atmosphere into the second and first stages. The stationary can has an outside diameter less than the inside diameter of the outer rotor and limited effect on the magnetic field of the outer rotor.

Then inside of the stationary can, the magnetic coupling has its inner rotor 45 generally coaxial with the idler shaft 5*a* extending from the second stage and mechanically secured to it as at 48*a*. The inner rotor is a somewhat round cylinder with a recess at its base, here shown as a thickened U shape with an extension at the base of the U shape. The inner rotor has an open end 45*b* and an opposite closed end 45*a* with an extension 45*c* recessed in from the wall 45*d* forming the inner rotor. The wall 45*d* is generally thick, much thicker in comparison to the walls of the stationary can and the outer rotor. In this alternate embodiment, the entire inner rotor has a magnetic polarity opposite that of the outer rotor. The opposite polarities attract the inner rotor to rotate in the direction of the outer rotor. Alternatively, the inner rotor has magnetic neutrality and includes a magnetic band 45*e* around the perimeter of the inner rotor that extends for substantially the length of the wall 45*d*. The magnetic band has an opposite magnetic polarity to the outer rotor. The inner rotor has an outer diameter less than the inside diameter of the stationary can. So, turning of the outer rotor by the eccentric shaft 67 causes the inner rotor to turn in the same direction through magnetic attraction without a physical connection of the eccentric shaft to the idler shaft between the third stage and the second stage. Additionally because the eccentric shaft turns magnetized parts within the magnetic coupling, the first fixed scroll, the second fixed scroll, the eccentric shaft, the motor, and the coupling are grounded to dissipate any electrical charge created by the rotating magnetic parts.

From the aforementioned description, a three stage vacuum pump from the machine class of scroll compressors, pumps, and expanders has been described. This three stage vacuum pump is uniquely capable of expanding and compressing a fluid cyclically to evacuate a line, device, or space connected to the invention without intrusion of the nearby atmosphere. During operation, this pump generates heat within its fixed and orbiting scrolls which is dissipated through cooperating fins upon the surrounding housing or through chambers in an alternate embodiment. This pump receives its motive power directly from a motor or alternatively from a motor connected to a magnetic coupling, further minimizing the incidence of atmospheric intrusion within the housing and the working fluid. The present invention and its various components may adapt existing equipment and may be manufactured from many materials including but not limited to metal sheets and foils, elastomers, steel plates, polymers, high density polyethylene, polypropylene, polyvinyl chloride, nylon, ferrous and non-ferrous metals, their alloys, and composites.

I claim:

1. A three stage vacuum device producing a vacuum of approximately two milli-torr comprising:

a first stage having a first fixed scroll and a first orbiting scroll, said first fixed scroll communicating to a space selected for evacuation, said first orbiting scroll having an inner face and an opposite outer face, said outer face of said first orbiting scroll meshing with said first fixed scroll;

a second stage adjacent to said first stage inwardly, said second stage in gaseous communication to said first stage, said second stage having a second fixed scroll, said second fixed scroll meshing with said inner face of said first orbiting scroll;

a third stage spaced inwardly of said second stage, said third stage in gaseous communication to said second stage, said third stage having a third fixed scroll and a second orbiting scroll, said second orbiting scroll meshing with said third fixed scroll;

a driving pin journaled to said second orbiting scroll opposite said third fixed scroll;

a motor operatively connected to said driving pin, said motor imparting rotation to said driving pin, said motor being generally opposite said first fixed scroll and outwardly of said second orbiting: scroll; and, said motor rotating said first orbiting scroll and said second orbiting scroll simultaneously thus evacuating gas molecules from the selected space.

2. The three stage vacuum device of claim 1 further comprising:

said second orbiting scroll driving at least one idler, said at least one idler extending through said third stage, said second stage, and said first stage.

3. The three stage vacuum device of claim 2 further comprising:

said at least one idler having an eccentric shaft through said third stage, said eccentric shaft having an axial chamber therein opposite said second orbiting scroll, an idler shaft having a first end and an opposite second end wherein said first end extends into said first fixed scroll and said second end inserts into said axial chamber of said eccentric shaft wherein said at least one idler transmits torque and rotation imparted through said second orbiting scroll by said motor to said second stage and said first stage.

4. The three stage vacuum device of claim 3 wherein said device has three idlers.

5. The three stage vacuum device of claim 3 further comprising:

said motor having an outward end and an inward end, a counterweight upon said outward end and a round shaft extending from said inward end;

said driving pin being an eccentric driving pin connecting to said second orbiting scroll wherein said eccentric driving pin induces orbital motion of said second orbiting scroll and said second orbiting scroll induces rotation in said eccentric shaft of said idler thus providing orbital motion from said third stage to said second stage and said first stage;

a crankshaft joining to said eccentric driving pin generally opposite said counterweight; said counterweight and said crankshaft providing balance to said third orbiting scroll wherein said device operates with a minimum of external vibration; and, a housing containing said second orbiting scroll and joining to said third fixed scroll.

6. The three stage vacuum device of claim 3 further comprising:

said motor having an inward end, a round shaft extending from said inward end, a flywheel upon said round shaft having a diameter greater than said sound shaft, and a driving pin coaxial with said round shaft;

said driving pin connecting to said second orbiting scroll wherein said driving pin induces rotation of said second orbiting scroll and said second orbiting scroll induces rotation in said eccentric shaft of said idler;

said eccentric shaft extending inwardly to a magnetic connection between said third stage and said second stage, said magnetic connection transmitting rotation and torque from said eccentric shaft to said second stage therein causing said first orbiting scroll to orbit.

7. The three stage vacuum device of claim 6 further comprising:

said magnetic connection including an outer rotor connecting to said eccentric shaft, said outer rotor having a magnetic polarity, a stationary can within said outer rotor connecting to said second fixed scroll, said stationary can lacking a magnetic polarity, and an inner rotor within said stationary can connecting to another eccentric shaft of said idler in said second stage, said inner rotor having a magnetic polarity opposite that of said outer rotor.

8. The three stage vacuum device of claim 7 further comprising:

said inner rotor having a band upon the circumference of said inner rotor, said band having a magnetic polarity opposite that of said outer rotor.

9. The three stage vacuum device of claim 2 further comprising:

an O-ring sealing said first fixed scroll to said second fixed scroll generally upon the perimeter of said first fixed scroll;

an O-ring sealing said second fixed scroll to said third fixed scroll generally around the circumference of said at least one idler;

said first fixed scroll having an involute, said involute having a tip locating inwardly;

said outer face having an involute with a tip locating outwardly and meshing with said involute of said first fixed scroll and said inner face having an involute with a tip locating inwardly;

said second fixed scroll having an involute with a tip locating outwardly and meshing with said involute of said inner face;

said third fixed scroll having an involute with a tip locating outwardly;

said second orbiting scroll having an involute with a tip locating inwardly and meshing with said involute of said third fixed scroll; and, each of said tips upon each of said scrolls sealing to an adjacent scroll.

10. The three stage vacuum device of claim 1 further comprising:

said second fixed scroll having a generally centered hub extending inwardly and opposite said first orbiting scroll, said hub having a centered passage for communication of gas molecules from said second stage to said third stage;

said third fixed scroll having a generally centered hub extending inwardly and opposite said second orbiting scroll, said hub having a centered passage for communication of gas molecules from said second fixed scroll into said third fixed scroll;

said hub of said second fixed scroll and said hub of said third fixed scroll align forming a common centered passage between said second stage and said third stage; and, an O-ring sealing said hub of said second fixed scroll to said hub of said third fixed scroll proximate to the perimeter of said hub of said third fixed scroll.

11. The three stage vacuum device of claim 10 further comprising:

said first fixed scroll having a plurality of fins extending outwardly of said device;

said second fixed scroll having a plurality of fins extending inwardly; and, said third fixed scroll having a plurality of fins extending inwardly and aligning with said plurality of fins of said second fixed scroll wherein said plurality of fins of said third fixed scroll and said plurality of fins of said second fixed scroll become continuous.

12. The three stage vacuum device of claim 1 further comprising:

at least one fan upon said device generally perpendicular to said motor and centered between said third stage and said second stage adapted to move atmospheric air through and over said device therein accelerating heat transfer from said device.

* * * * *